US007175127B2

(12) United States Patent
Butterworth et al.

(10) Patent No.: US 7,175,127 B2
(45) **Date of Patent: *Feb. 13, 2007**

(54) REWINDER APPARATUS AND METHOD

(75) Inventors: Tad T. Butterworth, Ashland, WI (US); Gerald L. Fellows, Elm Grove, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 131 days.

This patent is subject to a terminal disclaimer.

(21) Appl. No.: 10/926,850

(22) Filed: Aug. 26, 2004

(65) Prior Publication Data

US 2005/0087647 A1 Apr. 28, 2005

Related U.S. Application Data

(63) Continuation-in-part of application No. 10/259,163, filed on Sep. 27, 2002, now Pat. No. 6,877,689.

(51) Int. Cl.
*B65H 18/14* (2006.01)

(52) U.S. Cl. ..... 242/542.1; 242/533.1

(58) Field of Classification Search ..... 242/521, 242/532.2, 533, 533.7, 541, 541.2, 542, 542.1, 242/542.2

See application file for complete search history.

(56) References Cited

U.S. PATENT DOCUMENTS

| | | | |
|---|---|---|---|
| 1,681,046 | A | 8/1928 | Marresford |
| 1,719,830 | A | 7/1929 | Cameron |
| 1,894,253 | A | 1/1933 | McCarthy et al. |
| 1,934,913 | A | 11/1933 | Crisp |
| 2,020,118 | A | 11/1935 | Kellett et al. |
| 2,237,759 | A | 4/1941 | Kwitek |
| 2,266,995 | A | 12/1941 | Schultz et al. |
| 2,576,529 | A | 11/1951 | McKenney et al. |
| 2,676,764 | A | 4/1954 | Aulen |
| 2,769,600 | A | 11/1956 | Kwitek et al. |
| 2,775,410 | A | 12/1956 | Schwartz et al. |
| 2,870,340 | A | 1/1959 | Fransen |
| 2,870,840 | A | 1/1959 | Kwitek |
| 2,901,191 | A | 8/1959 | Phelps |
| 2,920,836 | A | 1/1960 | De Bell |
| 2,995,314 | A | 8/1961 | Nystrand |
| 3,030,042 | A | 4/1962 | De Gelleke |
| 3,049,311 | A | 8/1962 | Birch, Jr. |
| 3,123,315 | A | 3/1964 | Couzens |
| 3,148,843 | A | 9/1964 | Turner et al. |

(Continued)

FOREIGN PATENT DOCUMENTS

| | | |
|---|---|---|
| CA | 698907 | 12/1964 |

(Continued)

*Primary Examiner*—William A. Rivera
(74) *Attorney, Agent, or Firm*—Michael Best & Friedrich LLP

(57) ABSTRACT

A rewinder having a first winding roll that transports and supports the web, and a second winding roll located a distance from the first winding roll to define a nip therebetween. The rewinder also include at least one core support plate that is curved for receiving and guiding cores adjacent the first winding roll, a contact finger located adjacent the first winding roll, and a web separation bar adjacent the first winding roll and movable into pressing relationship with the web to press the web against the contact finger to separate the web. In some embodiments, the contact finger is recessed within the first winding roll such that the web separation bar presses the web only against the contact finger to separate the web.

73 Claims, 25 Drawing Sheets

U.S. PATENT DOCUMENTS

| | | | |
|---|---|---|---|
| 3,179,348 | A | 4/1965 | Nystrand et al. |
| 3,383,062 | A | 5/1968 | Meihofer et al. |
| 3,389,592 | A | 6/1968 | Bournez et al. |
| 3,471,097 | A | 10/1969 | Phelps |
| 3,498,558 | A | 3/1970 | Bradley |
| 3,514,047 | A | 5/1970 | DeMallie et al. |
| 3,532,572 | A | 10/1970 | Herman |
| 3,549,097 | A | 12/1970 | Seigh |
| 3,552,670 | A | 1/1971 | Herman |
| 3,614,010 | A | 10/1971 | Aulen |
| 3,680,804 | A | 8/1972 | Aaron et al. |
| 3,697,010 | A | 10/1972 | Nystrand et al. |
| 3,727,853 | A | 4/1973 | Kinoshita |
| 3,765,615 | A | 10/1973 | Brink et al. |
| 3,782,650 | A | 1/1974 | Donnell, Jr. |
| 3,791,602 | A | 2/1974 | Isakson |
| 3,791,603 | A | 2/1974 | Lenius |
| 3,794,255 | A | 2/1974 | Harmon et al. |
| 3,817,467 | A | 6/1974 | Dambroth |
| 3,823,887 | A | 7/1974 | Gerstein |
| 3,844,189 | A | 10/1974 | Jardine |
| 3,845,914 | A | 11/1974 | Straujups |
| 3,853,279 | A | 12/1974 | Gerstein |
| 3,856,226 | A | 12/1974 | Dowd, Jr. |
| RE28,353 | E | 3/1975 | Nystrand et al. |
| 3,869,095 | A | 3/1975 | Diltz |
| 3,871,595 | A | 3/1975 | Smolderen |
| 3,881,645 | A | 5/1975 | Kopp |
| 3,889,892 | A | 6/1975 | Melead |
| 3,910,517 | A | 10/1975 | Harrison, III |
| 3,926,299 | A | 12/1975 | Bradley et al. |
| 3,951,890 | A | 4/1976 | Reilly et al. |
| 3,965,333 | A | 6/1976 | Elsner et al. |
| 3,994,396 | A | 11/1976 | Reilly et al. |
| 4,033,521 | A | 7/1977 | Dee |
| 4,039,369 | A | 8/1977 | Versteege |
| 4,055,313 | A | 10/1977 | Yamaguchi et al. |
| 4,123,011 | A | 10/1978 | Kajiwara et al. |
| 4,133,495 | A | 1/1979 | Dowd |
| 4,153,215 | A | 5/1979 | Schulze |
| 4,171,780 | A | 10/1979 | Bugnone |
| 4,188,257 | A | 2/1980 | Kirkpatrick |
| 4,238,082 | A | 12/1980 | Lund |
| 4,256,269 | A | 3/1981 | Feighery et al. |
| RE30,598 | E | 5/1981 | Spencer |
| 4,265,409 | A | 5/1981 | Cox et al. |
| 4,280,669 | A | 7/1981 | Leanna et al. |
| 4,284,221 | A | 8/1981 | Nagel et al. |
| 4,285,621 | A | 8/1981 | Spencer |
| 4,327,877 | A | 5/1982 | Perini |
| 4,345,722 | A | 8/1982 | Kuhn |
| 4,370,193 | A | 1/1983 | Knauthe |
| 4,408,727 | A | 10/1983 | Dropczynski |
| 4,422,586 | A | 12/1983 | Tetro |
| 4,422,588 | A | 12/1983 | Nowisch |
| 4,444,360 | A | 4/1984 | Kaipf et al. |
| 4,445,646 | A | 5/1984 | Karr et al. |
| 4,448,363 | A | 5/1984 | Mukenschnabl |
| 4,460,169 | A | 7/1984 | Bartesaghi |
| 4,485,979 | A | 12/1984 | Dropczynski |
| 4,485,980 | A | 12/1984 | Gorner |
| 4,487,377 | A | 12/1984 | Perini |
| 4,487,378 | A | 12/1984 | Kobayashi |
| 4,489,900 | A | 12/1984 | Morizzo |
| 4,496,112 | A | 1/1985 | Olsson et al. |
| 4,508,279 | A | 4/1985 | Tokuno et al. |
| 4,508,283 | A | 4/1985 | Beisswanger |
| 4,515,321 | A | 5/1985 | Kahlman |
| 4,516,735 | A | 5/1985 | Snygg |
| 4,529,141 | A | 7/1985 | McClenathan |
| 4,541,583 | A | 9/1985 | Forman et al. |
| 4,546,930 | A | 10/1985 | Rohde et al. |
| 4,552,316 | A | 11/1985 | Dropczynski et al. |
| 4,575,018 | A | 3/1986 | Ichikawa |
| 4,577,789 | A | 3/1986 | Hofmann et al. |
| 4,583,698 | A | 4/1986 | Nistri et al. |
| 4,588,138 | A | 5/1986 | Spencer |
| 4,601,441 | A | 7/1986 | Oinonen et al. |
| 4,606,381 | A | 8/1986 | Suwa et al. |
| 4,635,867 | A | 1/1987 | Kytonen |
| 4,667,890 | A | 5/1987 | Geitman, Jr. |
| 4,687,153 | A | 8/1987 | McNeil et al. |
| 4,695,005 | A | 9/1987 | Geitman, Jr. |
| 4,697,755 | A | 10/1987 | Kataoka |
| 4,721,266 | A | 1/1988 | Haapanen et al. |
| 4,723,724 | A | 2/1988 | Bradley |
| 4,775,110 | A | 10/1988 | Welp et al. |
| 4,783,015 | A | 11/1988 | Shimizu |
| 4,789,109 | A | 12/1988 | Kyytsonen et al. |
| 4,798,350 | A | 1/1989 | Jorgensen et al. |
| 4,807,825 | A | 2/1989 | Eisner et al. |
| 4,828,195 | A | 5/1989 | Hertel et al. |
| 4,842,209 | A | 6/1989 | Saukkonen |
| 4,856,725 | A | 8/1989 | Bradley |
| 4,858,844 | A | 8/1989 | Stenquist |
| 4,874,158 | A | 10/1989 | Retzloff |
| 4,875,632 | A | 10/1989 | Kataoka |
| 4,892,119 | A | 1/1990 | Hugo et al. |
| 4,895,315 | A | 1/1990 | Salmela et al. |
| 4,909,452 | A | 3/1990 | Hertel et al. |
| 4,919,351 | A | 4/1990 | McNeil |
| 4,930,977 | A | 6/1990 | Beeman et al. |
| 4,931,130 | A | 6/1990 | Biagiotti |
| 4,932,599 | A | 6/1990 | Doerfel |
| 4,962,897 | A | 10/1990 | Bradley |
| 4,967,804 | A | 11/1990 | Gotti |
| 4,977,803 | A | 12/1990 | Blom |
| 4,988,051 | A | 1/1991 | Welschlau et al. |
| 4,997,119 | A | 3/1991 | Meschi |
| 5,000,436 | A | 3/1991 | Holmes |
| 5,012,736 | A | 5/1991 | Van Kanegan et al. |
| 5,031,850 | A | 7/1991 | Biagiotti |
| 5,038,647 | A | 8/1991 | Biagiotti |
| 5,040,663 | A | 8/1991 | Gould et al. |
| 5,040,738 | A | 8/1991 | Biagiotti |
| 5,079,901 | A | 1/1992 | Kotsiopoulos |
| 5,100,040 | A | 3/1992 | Kunreuther et al. |
| 5,104,055 | A | 4/1992 | Buxton |
| 5,114,306 | A | 5/1992 | Sjogren et al. |
| 5,137,225 | A | 8/1992 | Biagiotti |
| 5,141,142 | A | 8/1992 | Ramsey |
| 5,150,848 | A | 9/1992 | Consani |
| 5,150,850 | A | 9/1992 | Adams |
| 5,222,679 | A * | 6/1993 | Dropczynski et al. ..... 242/521 |
| 5,226,611 | A | 7/1993 | Butterworth et al. |
| 5,230,453 | A | 7/1993 | Meschi |
| 5,240,196 | A | 8/1993 | Baarfuesser |
| 5,248,106 | A | 9/1993 | Biagiotti |
| 5,249,756 | A | 10/1993 | Biagiotti |
| 5,257,898 | A | 11/1993 | Blume |
| 5,267,703 | A | 12/1993 | Biagiotti |
| 5,271,137 | A | 12/1993 | Schutz |
| 5,273,222 | A | 12/1993 | Hutzenlaub et al. |
| 5,273,226 | A | 12/1993 | Dropczynski |
| 5,285,977 | A | 2/1994 | Biagiotti |
| 5,310,130 | A | 5/1994 | Wieland et al. |
| 5,312,059 | A | 5/1994 | Membrino |
| 5,315,907 | A | 5/1994 | Biagiotti |
| 5,335,871 | A | 8/1994 | Fissmann et al. |
| 5,344,091 | A | 9/1994 | Molison |
| 5,346,151 | A | 9/1994 | Zimmermann et al. |
| 5,357,833 | A | 10/1994 | Biagiotti |
| 5,368,252 | A | 11/1994 | Biagiotti |
| 5,368,253 | A | 11/1994 | Hartley, Jr. |

| | | | |
|---|---|---|---|
| 5,370,335 | A | 12/1994 | Vigneau |
| 5,377,930 | A | 1/1995 | Noyes |
| 5,383,622 | A | 1/1995 | Kohler |
| 5,387,284 | A | 2/1995 | Moody |
| 5,390,875 | A | 2/1995 | Gietman, Jr. et al. |
| 5,402,960 | A | 4/1995 | Oliver et al. |
| 5,407,509 | A | 4/1995 | Ishizu |
| 5,409,178 | A | 4/1995 | Stauber |
| 5,453,070 | A | 9/1995 | Moody |
| 5,454,687 | A | 10/1995 | Johnson et al. |
| 5,460,258 | A | 10/1995 | Tisma |
| 5,467,936 | A | 11/1995 | Moody |
| 5,484,499 | A | 1/1996 | Marschke |
| 5,492,287 | A | 2/1996 | Raudaskoski et al. |
| 5,497,959 | A | 3/1996 | Johnson et al. |
| 5,505,402 | A | 4/1996 | Vigneau |
| 5,505,405 | A | 4/1996 | Vigneau |
| 5,508,279 | A | 4/1996 | Gray |
| 5,509,336 | A | 4/1996 | Biagiotti |
| 5,513,478 | A | 5/1996 | Abt |
| 5,518,200 | A | 5/1996 | Kaji et al. |
| 5,518,490 | A | 5/1996 | Ziegelhoffer |
| 5,522,292 | A | 6/1996 | Biagiotti |
| 5,524,677 | A | 6/1996 | Summey, III |
| RE35,304 | E | 7/1996 | Biagiotti |
| 5,538,199 | A | 7/1996 | Biagiotti |
| 5,542,622 | A | 8/1996 | Biagiotti |
| 5,544,841 | A | 8/1996 | Didier et al. |
| 5,558,488 | A | 9/1996 | Gentry |
| 5,573,615 | A | 11/1996 | Vigneau et al. |
| 5,575,135 | A | 11/1996 | Nordstrom |
| 5,577,684 | A | 11/1996 | Dropczynski |
| 5,588,644 | A | 12/1996 | Lotto et al. |
| 5,603,467 | A | 2/1997 | Perini et al. |
| 5,620,151 | A | 4/1997 | Ueyama et al. |
| 5,632,456 | A | 5/1997 | Kruger |
| 5,639,045 | A | 6/1997 | Dorfel |
| 5,639,046 | A | 6/1997 | Biagiotti |
| 5,653,401 | A | 8/1997 | Biagiotti |
| 5,660,349 | A | 8/1997 | Miller et al. |
| 5,660,350 | A | 8/1997 | McNeil et al. |
| 5,667,162 | A | 9/1997 | McNeil et al. |
| 5,690,296 | A | 11/1997 | Biagiotti |
| 5,690,297 | A | 11/1997 | McNeil et al. |
| 5,722,608 | A | 3/1998 | Yamazaki |
| 5,725,176 | A | 3/1998 | Vigneau |
| 5,730,387 | A | 3/1998 | Yamazaki |
| 5,732,901 | A | 3/1998 | McNeil et al. |
| 5,746,379 | A | 5/1998 | Shimizu |
| 5,759,326 | A | 6/1998 | Vigneau |
| 5,769,352 | A | 6/1998 | Biagiotti |
| 5,772,149 | A | 6/1998 | Butterworth |
| 5,772,391 | A | 6/1998 | Sjogren et al. |
| 5,785,224 | A | 7/1998 | Nowakowski |
| 5,791,248 | A | 8/1998 | Atkins et al. |
| 5,796,221 | A | 8/1998 | Cramer et al. |
| 5,799,467 | A | 9/1998 | Nankervis et al. |
| 5,800,652 | A | 9/1998 | Vigneau et al. |
| 5,810,279 | A | 9/1998 | Rodriguez et al. |
| 5,810,282 | A | 9/1998 | McNeil et al. |
| 5,820,064 | A | 10/1998 | Butterworth |
| 5,839,680 | A | 11/1998 | Biagiotti |
| 5,839,688 | A | 11/1998 | Hertel et al. |
| 5,845,867 | A | 12/1998 | Hould et al. |
| 5,853,140 | A | 12/1998 | Biagiotti |
| 5,901,917 | A | 5/1999 | Schmidt et al. |
| 5,979,818 | A | 11/1999 | Perini et al. |
| 6,000,657 | A | 12/1999 | Butterworth |
| 6,050,519 | A | 4/2000 | Biagiotti |
| 6,056,229 | A | 5/2000 | Blume et al. |
| 6,135,281 | A | 10/2000 | Simhaee |
| 6,308,909 | B1 | 10/2001 | McNeil et al. |
| 6,328,248 | B1 | 12/2001 | Kaipf |
| 6,354,530 | B1 | 3/2002 | Byrne et al. |
| 6,422,501 | B1 | 7/2002 | Hertel et al. |
| 6,479,383 | B1 | 11/2002 | Chooi et al. |
| 6,488,226 | B2 | 12/2002 | McNeil et al. |
| 6,494,398 | B1 | 12/2002 | De Matteis et al. |
| 6,497,383 | B1 | 12/2002 | Dual et al. |
| 6,595,458 | B1 | 7/2003 | Biagiotti |
| 6,648,266 | B1 | 11/2003 | Biagiotti et al. |
| 6,877,689 | B2 * | 4/2005 | Butterworth ..... 242/542.1 |

FOREIGN PATENT DOCUMENTS

| | | |
|---|---|---|
| CA | 2073931 | 1/1993 |
| DE | 2351699 | 4/1975 |
| DE | 2400178 | 7/1975 |
| DE | 1935584 | 6/1978 |
| DE | 2920707 | 12/1980 |
| DE | 3151256 | 10/1982 |
| DE | 3205801 | 8/1983 |
| DE | 3434223 | 1/1986 |
| DE | 3611895 | 10/1987 |
| DE | 3911377 | 10/1989 |
| DE | 4130679 | 3/1993 |
| DE | 4213712 | 10/1993 |
| EP | 0061634 | 10/1982 |
| EP | 0072315 | 2/1983 |
| EP | 0089933 | 9/1983 |
| EP | 0190629 | 2/1985 |
| EP | 0306092 | 3/1989 |
| EP | 0408526 | 7/1989 |
| EP | 0387214 | 9/1990 |
| EP | 0498039 | 1/1991 |
| EP | 0427408 | 5/1991 |
| EP | 0452284 | 10/1991 |
| EP | 0524158 | 1/1993 |
| EP | 0555728 | 8/1993 |
| EP | 0694020 | 3/1994 |
| EP | 0909735 | 8/1994 |
| EP | 0629372 | 12/1994 |
| EP | 0853060 | 7/1998 |
| EP | 0867392 | 9/1998 |
| EP | 0872440 | 10/1998 |
| FR | 2544701 | 10/1984 |
| FR | 2623177 | 5/1989 |
| GB | 1435525 | 5/1976 |
| GB | 1516097 | 6/1978 |
| GB | 2090582 | 7/1982 |
| GB | 2105688 | 3/1983 |
| GB | 2150536 | 3/1983 |
| GB | 2120639 | 12/1983 |
| GB | 2161787 | 7/1984 |
| GB | 2150536 | 1/1985 |
| GB | 2145399 | 3/1985 |
| GB | 2167938 | 11/1985 |
| IT | 1435525 | 7/1973 |
| IT | 1033778 | 8/1979 |
| IT | 1213819 | 11/1979 |
| IT | 1167982 | 3/1987 |
| IT | 1192499 | 4/1988 |
| IT | 1213820 | 1/1990 |
| IT | 1233280 | 3/1992 |
| IT | 1234455 | 5/1992 |
| IT | 1258172 | 2/1996 |
| IT | 1259660 | 3/1996 |
| JP | 35244377 | 4/1977 |
| JP | 11100163 | 4/1999 |
| JP | 11193173 | 7/1999 |
| WO | WO 94/21545 | 9/1994 |
| WO | WO 9510472 | 4/1995 |
| WO | WO 0068129 | 11/2000 |
| WO | WO 2004/028938 | 4/2004 |

* cited by examiner

Figure
15

REWINDER APPARATUS AND METHOD

RELATED APPLICATIONS

This application is a continuation-in-part of and claims the benefit of priority to U.S. patent application Ser. No. 10/259,163, filed Sep. 27, 2002, now U.S. Pat. No. 6,877,689 the entire contents of which are incorporated by reference herein.

FIELD OF THE INVENTION

The invention relates to rewinders for use in the production of web products.

BACKGROUND OF THE INVENTION

Significant developments in web rewinding have placed ever-increasing product output demands upon web rewinders. Conventional web rewinders are capable of winding a roll or "log" of material in seconds, with maximum winding speeds determined by the strength and other properties of the web and the core upon which the web is wound. Such rewinders are generally limited in their ability to control the position and movement of cores through the rewinder nip, and therefore have limited control over web separation (where cores or core insertion devices perform web separation) and web transfer to new cores. As used hereinafter and in the appended claims, the term "nip" refers to an area between two winding elements, such as between two winding rolls, a winding roll and conveyor belt, two facing conveyor belts, or other elements known to those skilled in the art used to rotate and wind a log therebetween.

The nip can include an area disposed from the narrowest point between two winding elements, such as when a three-roll winding cradle is employed. The term "web" as used herein and in the appended claims means any material (including without limitation paper, metal, plastic, rubber or synthetic material, fabric, and the like) which can be or is found in sheet form (including without limitation tissue, paper toweling, napkins, foils, wrapping paper, food wrap, woven and non-woven cloth or textiles, and the like). The term "web" does not indicate or imply any particular shape, size, length, width, or thickness of the material.

Although faster rewinding speeds are desired, a number of problems arise in conventional rewinders when their maximum speeds are approached, reached, and exceeded. Specifically, the position and orientation of cores entering the winding nip is important to proper web transfer and web separation, but is often variable especially at high rewinder speeds. In some rewinders, a rewinder element separates the web either by pinching the web (thereby creating sufficient web tension between the pinch point and the downstream winding roll to break the web) or by cutting the web. The position and orientation of the core in such rewinders is important to ensuring that the newly-separated web begins to wrap around the core without wrinkling or web damage.

In many conventional rewinders, the web is separated into a trailing edge and a leading edge by a web separating device once the rewound log reaches a predetermined size or sheet count. The trailing edge of the web is wound around the nearly completed log, while the leading edge of the web is wound around a new core that has been positioned near the winding nip. The types of web separating devices vary in form, shape, type of motion and location within the rewinder. In some rewinders, the web is separated by effectively slowing or stopping the motion of the advancing web with the web separating means, thereby causing the web to separate downstream of the web separating means and upstream of the nearly completed log. This type of separation causes the web upstream of the web separating means to develop slack, thus complicating winding of the leading edge of the separated web onto a new core. This type of separation, however, can still be useful depending on the distance between the nearly completed log and the web separating means. If this distance is large relative to the distance between perforations (if a perforated web is employed) reliability and accuracy of web separation can be compromised. In other types of rewinders, the web is separated by effectively speeding up the motion of the advancing web with the web separating means, thereby causing the web to separate upstream of the web separating means.

In light of the limitations of the prior art described above, a need exists for an apparatus and method for a web rewinder in which sufficient core control is maintained to accurately and consistently insert and guide cores toward a rewinder nip, webs can be wound at very high speeds without winding errors, web material can be properly transferred to a newly inserted core, and predictable and reliable web separation is enabled even though significantly different web materials and types are run in the rewinder. Each preferred embodiment of the present invention achieves one or more of these results.

SUMMARY OF THE INVENTION

Some embodiments of the present invention have an apparatus capable of winding a web onto a core. The apparatus includes a first winding roll, a second winding roll located a distance from the first winding roll to define a winding nip therebetween, and a core support plate on which the core is received and moved toward the winding nip. The apparatus also includes a contact finger located adjacent a first winding roll and a web separation bar movable toward the web to press the web against the contact finger to separate the web.

In some embodiments, a first portion of the contact finger is recessed within the first winding roll and a second portion of the contact finger is movable to a position outside an outer surface of the first winding roll. In such an embodiment, the web separation bar is movable into and out of pressing relationship against the second portion of the finger. In some embodiments, the contact finger is ring-shaped and is located about the first winding roll, and in still other embodiments, the contact finger is concentric with the center of the first winding roll.

The apparatus described above can be used to perform a method of winding a web onto a core in a rewinder. The method includes passing a web over a surface of the first winding roll, passing the web across a contact finger located adjacent the first winding roll, and moving a core onto a core support plate and toward the nip. The method also includes moving a web separation bar toward the web, pressing the web between the web separation bar and the contact finger, separating the web into a leading edge and a trailing edge, moving the web separation bar away from the web, and winding the leading edge around the core.

In some embodiments, pressing the web includes drawing the web separation bar across a surface of the contact finger. Pressing the web may futher include drawing the web across an apex of the contact finger surface to generate a tension spike in the web. In other embodiments, the pressure exerted against the web is substantially constant as the web separation bar is drawn across the surface of the contact finger. In yet other embodiments, the web is pressed only between the web separation bar and the contact finger.

Some other embodiments of the present invention have an apparatus capable of winding a web onto a core including a first winding roll rotatable about a first axis, and a second winding roll located a distance from the first winding roll to define a winding nip therebetween. The apparatus also includes a web separation bar rotatable about a second axis to press the web between a tip of the web separation bar and a surface on the opposite side of the web to separate the web. The tip defines a travel path during rotation of the web separation bar. The position of the travel path of the tip relative to the first axis is adjustable.

Some other embodiments of the present invention have an apparatus capable of winding a web onto a core, including a first winding roll and a second winding roll located a distance from the first winding roll to define a winding nip therebetween. The apparatus also includes a web separation bar having a base and a tip, such that the base slidably receives the tip, coupling the tip to the base. The web separation bar is movable toward the web to press the web between the tip and a surface on the opposite side of the web.

In some embodiments, the web separation bar includes a plurality of tips which are movable into contact with the web. In other embodiments, the tip includes at least one recess configured to receive a portion of the first winding roll therein as the tip moves into contact with the web.

Some other embodiments of the present invention include an apparatus capable of winding a perforated web onto a core. The apparatus includes a first winding roll, and a second winding roll located a distance from the first winding roll to define a winding nip therebetween. The apparatus also includes a core support plate on which the core is received and moved toward the winding nip. A web separation bar is movable toward the web to separate the web, the web separation bar having a base and a tip. The tip of the web separation bar contacts the web on both sides of a perforation in the web and breaks the web along the perforation.

In some embodiments, the tip includes a first portion and a second portion such that the tip stretches the web between the first and second portions of the tip until the web separates along the perforation. In other embodiments, the perforation is substantially centered between the first and second portions when the tip contacts the web. In yet other embodiments, the web separation bar is accelerated to a velocity substantially equal to the velocity of the moving web.

Since the distance between the core and the web separator is controlled to be short relative to the distance between perforations in the web (if a perforated web is employed) the present invention allows for accurate, reliable and consistent web separation. Furthermore, the leading edge of the web is not wrinkled and allows for facile and accurate transfer of the leading edge of the web to a new core.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show exemplary embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts:

FIG. 20 is a partial detail view of the contact finger of FIG. 18;

DETAILED DESCRIPTION

Figure 1:
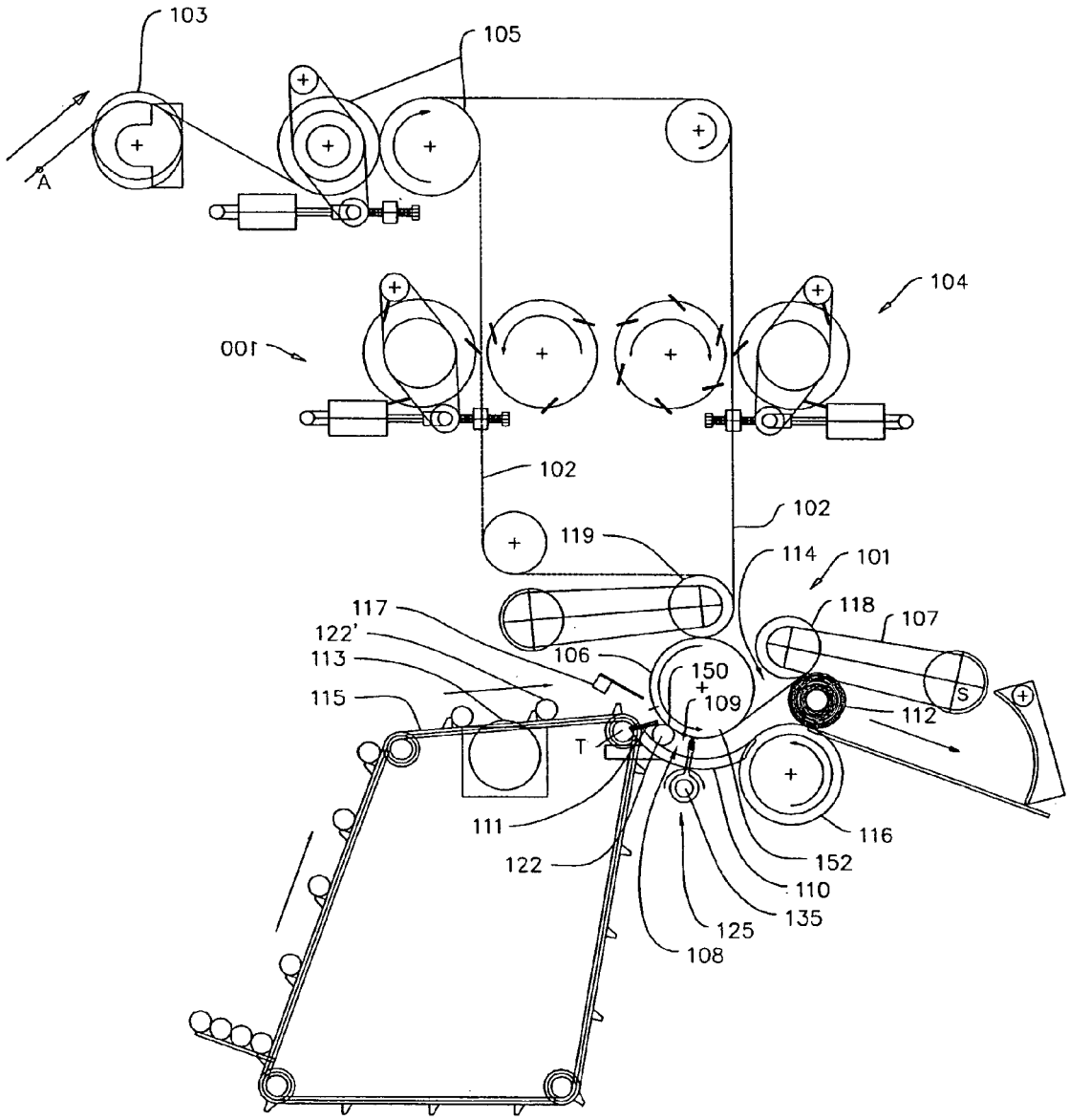
FIG. 1 is an elevational view of the rewinder according to a first preferred embodiment of the present invention.
Figure 2:
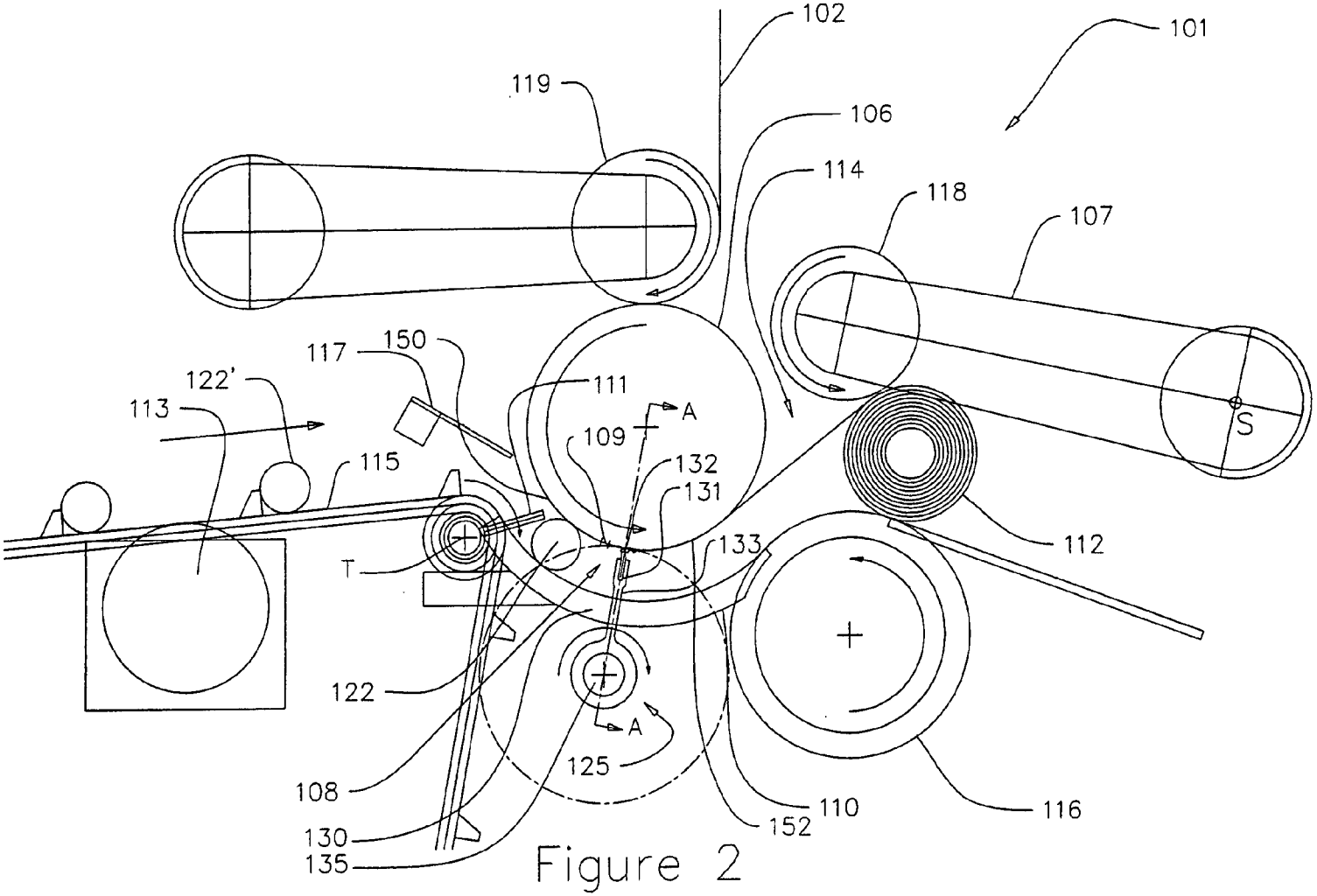
FIG. 2 is a detail view of the rewinder illustrated in FIG. 1, showing the first and second winding rolls, the rider roll, the core insertion device, the adhesive application area, the core support surface, and the web separator.

Referring to the figures, and more particularly to FIGS. 1 and 2, a rewinder constructed in accordance with some of the embodiments of the invention is shown generally at 100. The rewinder 100 includes a number of stations at which various functions are performed. In some of the embodiments, a web 102 of material enters the machine by passing over a bowed roll 103 for minimizing wrinkles in the web 102, then through a set of pull rolls 105 for controlling tension of the web 102. In some embodiments of the present invention, the web 102 then passes through one or more perforation stations 104. Any number of bowed rolls 103, pull rolls 105 or perforation stations 104 can be used without departing from the present invention. Furthermore, in some embodiments of the invention, no bowed roll 103, pull roll 105 or perforation station 104 is used. For the purpose of example only, one perforation station can be set up for the production of kitchen towels while another station can be set up for bathroom tissue. Other types of perforation stations known to those skilled in the art can be employed without departing from the present invention.

In some embodiments, the web 102 is perforated transversely at one of the perforation stations 104 and is then directed around the ironing roll 119 to a first winding roll 106. Any number of ironing rolls 119 can be used in accordance with the present invention, including an embodiment in which no ironing rolls 119 are used. In the embodiments illustrated in FIGS. 1–13, the web material 102 rewound and separated in this rewinder 100 is periodically perforated, but the web 102 can also be a continuous stream without perforations, or have perforations but not periodic or regular perforations.

As used herein and in the appended claims, the term "upstream" is used to describe any location, element or process that occurs prior to the point or area being referred to; whereas, the term "downstream" is used to describe any location, element or process that occurs ahead of the point or area of reference.

Any upstream equipment or elements for manufacturing, treating, modifying or preparing the web 102 before it reaches the throat 108 can be employed without departing from the present invention. The upstream elements illustrated in FIG. 1 are used only for the purpose of example.

A variety of materials can be rewound satisfactorily using the present invention. As used herein and in the appended claims the term "web" is not limited to tissue, napkin stock, and other paper product, but instead refers to any product found in sheet form, including without limitation, paper, plastic wrap, wax paper, foil, fabric, cloth, textile, and any other sheet material capable of being rewound in the rewinder 100. However, a paper web 102 is described herein for illustrative purposes. The web 102 passes around the first winding roll 106 and into a throat 108 formed between the first winding roll 106 and at least one core support plate 110. As shown in the illustrated embodiment of FIG. 1, a conveyor 115 picks up cores 122 and carries them to an adhesive application area 113. Although shown in the illustrated embodiment of FIG. 1, the use of adhesive is not required in order to practice any embodiment of the present invention. The adhesive, if used, is applied to cores 122 by any of a variety of applicators, including a sprayer, brush, gun, syringe, device for dipping the core into adhesive, and any other similar adhesive applicator or method well-known to those skilled in the art. The conveyor 115 continues moving cores 122 to the winding area 101 of the rewinder 100, as depicted in FIG. 2. A core inserter 111 pushes the core 122 into the throat 108. Other core conveyors, as described below in greater detail, that do not move cores 122 to an adhesive application area or pick up cores 122 but simply deliver cores 122 to the throat 108 can be employed without departing from the present invention. The core conveyor 115 and core inserter 111 described above are presented by way of example only.

In some embodiments of the present invention, paper logs 112 are wound in a nip 114 between the first winding roll 106, a second winding roll 116 and a rider roll 118 as known in the art, although the invention also offers advantages in other rewinding processes, including winding the web 102 partially or fully around a core 122 in the throat 108, winding the web 102 between two side-by-side rolls without the use of a rider roll, and any other orientation or combination of winding rolls or core support plates 110 capable of winding the web 102 around a core 122 or mandrel. If employed, the rider roll 118 is movable from a position close to the winding rolls 106, 116 when the log 112 is relatively small to a position away from the winding rolls 106, 116 as the diameter of the log 112 increases. Many different devices can be used to move the rider roll 118, including a pivot arm 107 pivotable about a first axis S, an accordion-style system of bellows that is compressed as the diameter of the log 112 increases, a fixed or movable cam member with an aperture or surface upon which an extension of the rider roll 118 follows as the diameter of the log 112 increases, and any other equipment or element capable of moving the rider roll 118 away from the other rolls 106, 116 to accommodate an increasing log 112 diameter. The pivot arm 107 and first axis S are shown in FIG. 2 only for exemplary purposes.

While roll structures are illustrated in FIGS. 1, 2 and 4–13 and described herein, belts and other mechanisms, as described in greater detail below, capable of transporting the web 102 to the throat and winding the web 102 can also be used satisfactorily without departing from the present invention. For example, the web 102 can be wound around a moving belt, moving in a circular path or otherwise, instead of the first winding roll 106.

Referring to FIGS. 1–13, at least one core support plate 110 receives and guides cores 122 into and through the throat 108 toward the nip 114, while a web separator 125 generates separation of the web 102. The web separator 125 has one or more fingers 130, bases 133 and tips 132. A web separation bar 124 (see FIG. 3) is defined by one or more tips 132 (or bases 133 if no tips 132 are used, or if the tips are integrally part of the bases). While the embodiments illustrated in FIGS. 1–13 use cores 122, it will be apparent that the present invention is useful for winding coreless products using mandrels or other winding initiation devices as well. Accordingly, the disclosure herein referring to the use of the cores 122 in rewinding operations of the present invention is equally applicable to the use of mandrels in such operations.

The web separator 125 can take a number of different forms, as described below in greater detail. In the illustrated embodiment of FIG. 3, the web separator 125 is composed of a plurality of elongated web separation fingers 130 arranged on and extending radially from a common shaft 135 that runs transversely in the rewinder 100, but the web separator 125 can be located on any number of different shafts or other rotatable elements as desired. The fingers 130 allow for the passage of at least one core support plate 110 therebetween by providing a plurality of open spaces between each finger 130 through which at least one core support plate 110 can move. Additionally, in some embodiments, the web separation bar 124 is movable into and out of the throat 108 to contact the web 102 adjacent the first winding roll 106 at a velocity at least equal to that of a portion of the web 102 adjacent the first winding roll 106. In some embodiments, the web separation bar 124 is mounted for rotation into and out of the throat 108. Additionally, in some embodiments, the motion of the web separation bar 124 is generally directed clockwise with reference to FIG. 2, but can also be directed counterclockwise with reference to FIG. 2, or intermittently clockwise, then counterclockwise, or vice versa, or can be rotated, pivoted, or moved in any other manner to bring the web separation bar 124 into contact with the web 102 at a greater velocity than the portion of the web 102 adjacent the first winding roll 106.

Figure 5:
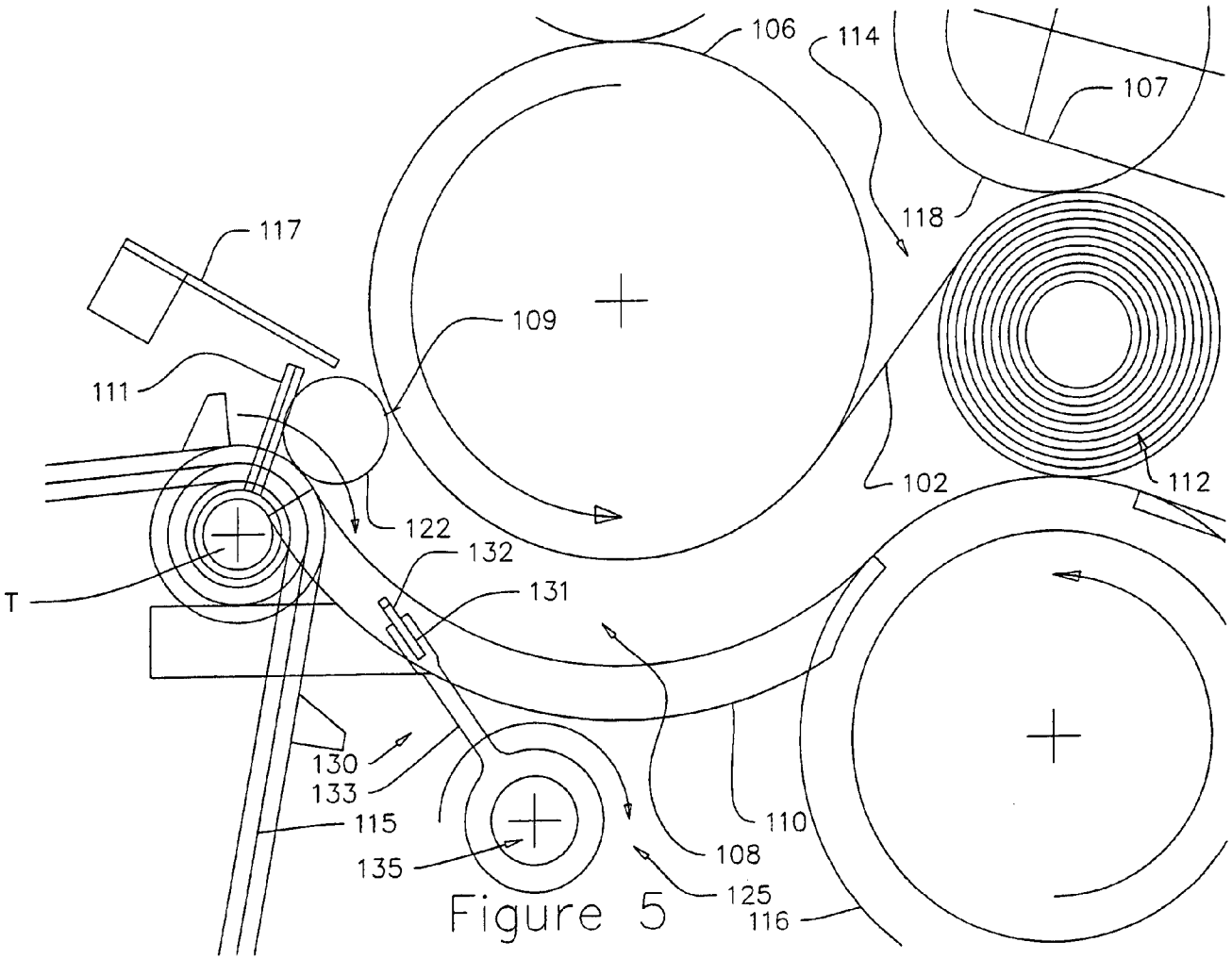
Figure 6:
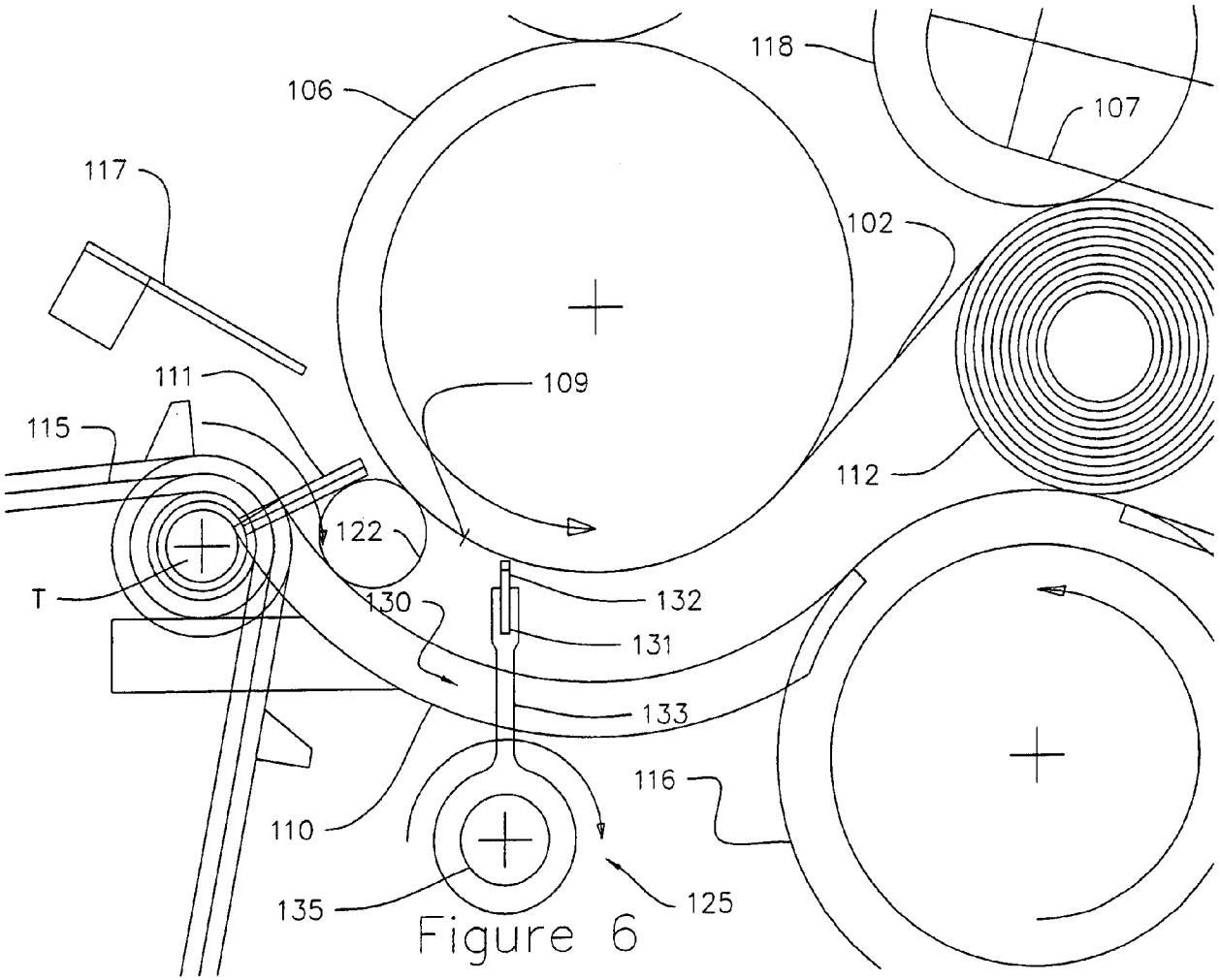

As shown in FIG. 6, at least one resilient tip 132 of the web separation bar 124 on a base 133 (or base 133 if no tip is used, or if the tip is integrally part of the base) pinches the web 102 between the resilient tip 132 and the first winding roll 106 downstream of the core 122. The one or more tips 132 can comprise a variety of resilient or rigid materials. In some embodiments, the tip 132 comprises polyurethane having a durometer of between sixty and one hundred, although other materials, such as polyurethane having a durometer outside of the aforementioned range, rubber, silicone, ultra-high molecular weight poly(ethylene), aluminum, steel, and any other material capable of contacting and separating the web 102 can also be employed without departing from the present invention. Furthermore, the tip can be mounted to a base 133 of the web separator 125 in any manner. The tip 132 can be mounted directly to the base 133 as illustrated in FIGS. 1, 2 and 4–11 by placing the tip 132 inside a recess 131 in the base 133 and bolting the tip 132 in place, or by having one side of the base 133 removable and bolted back in place over the tip 132 capturing the tip in the recess 131, or by clamping the base 133 closed over the tip 132 either with additional clamps or by having the base 133 itself function as the clamp, or by fitting the tip 132 into the recess 131 of the base 133 with a snap-fit between at least one rib on the tip and at least one groove in the recess 131 of the base 133, or by defining the entire web separation finger 130 with the tip 132, provided a sufficiently durable material is used.

Alternatively, the tip 132 can be spring mounted to the base 133 to provide resilience. For example, a variety of materials can be coupled between the tip 132 and the base 133, including without limitation one or more compression springs, one or more blocks and/or layers of rubber, polyurethane, silicone, and any other material capable of providing resilience to the tip 132. The resilient nature of the tip 132 in some embodiments enables tolerances for the interference between the first winding roll 106 and the tip 132 to be less restrictive while maintaining product quality and performance.

In some embodiments, the one or more resilient tips 132 of the web separation bar 124 travel through a circular path, represented by a dash-dot circle in FIG. 2, intersecting or tangent to the path traveled by the advancing stream of web. In some embodiments, the web separation fingers 130 are arranged on a common shaft 135 running transversely in the rewinder 100, but can be located on any number of different shafts or other rotatable elements as desired. In other embodiments, the one or more resilient tips 132 of the web separation bar 124 travel through a non-circular path, such as a path that is substantially triangular, rectangular, square, straight, arcuate, and the like. It will be apparent to one of ordinary skill in the art that any path shape can be used, provided the one or more resilient tips 132 contact the web at the desired location.

Figure 3:
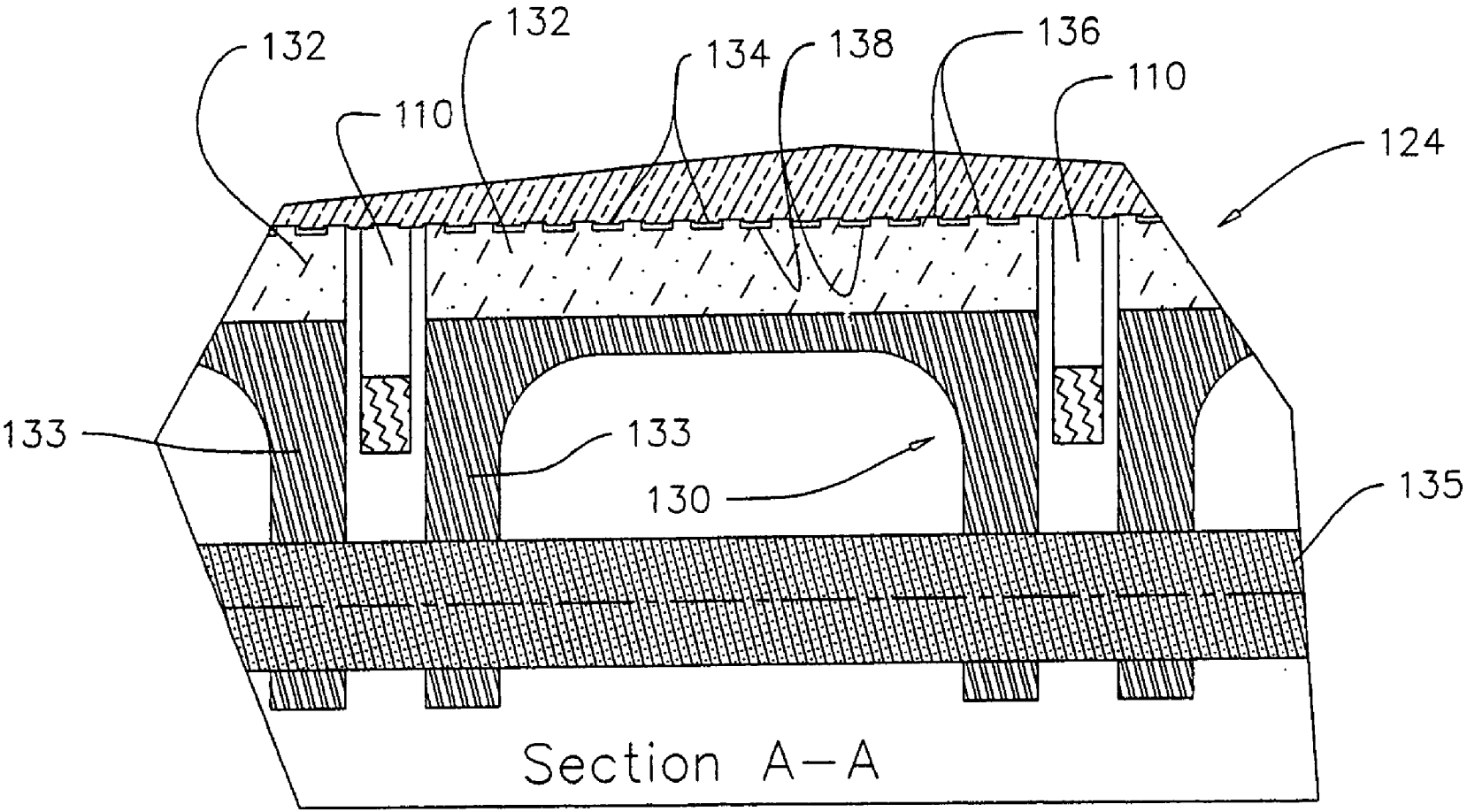
FIG. 3 is a cross-sectional view of the rewinder illustrated in FIGS. 1 and 2 taken along line A—A of FIG. 2.

FIG. 3 shows that the first winding roll 106 of the illustrated embodiments comprises alternating annular rings of a high friction surface 134 and a low friction surface 136 spaced transversely; that is, some rings have a higher coefficient of friction than others. The annular rings of the first winding roll 106 can be arranged in any pattern, but the rings are shown as alternating rings of high friction surface 134 and a low friction surface 136 for the purpose of example only. However, any ratio of high to low friction surface areas across the roll can be used. The high friction surfaces 134 are shown as ridges for clarity in the exemplary embodiment illustrated in FIG. 3, although in some embodiments the high friction surfaces 134 would be raised only slightly above that of the low friction surfaces 136. One or more of a number of different materials can be used for the high friction surfaces 134, including without limitation emery cloth; rubber; polyurethane; any knurled or embossed surface; unpolished wood, natural or otherwise; and any other material with a higher coefficient of friction than the material used on other rings of the first winding roll 106. Similarly, one or more of a number of different materials can be used for low friction surfaces, including without limitation poly tetrafluoroethylene (PTFE); ultra-high molecular weight polyethylene; polished steel; aluminum; silicone; polished wood, natural or otherwise; and any material with a lower coefficient of friction than the accompanying higher friction surface material chosen. Thus, any combination of materials can be used for the annular rings on the first winding roll 106 where the materials chosen for some of the rings have a higher coefficient of friction than the materials chosen for the other rings.

In some embodiments of the present invention, the one or more resilient tips 132 of the web separation bar 124 comprise recessed areas 138 to prevent contact of the one or more resilient tips 132 with the high friction surfaces 134 of the first winding roll 106. Although FIG. 3 illustrates an embodiment where the tips 132 have recesses 138 to accommodate the high friction surfaces 134, tips 132 with no recesses 138 or tips 132 with recesses 138 that do not accommodate the high friction surfaces 134 of the first winding roll 106 are also well within the spirit and scope of the present invention. Upon intersecting the path of the web 102, which is advancing adjacent the first winding roll 106, as shown in FIGS. 1–13, the web separation bar 124 contacts the web 102 and pinches it against the first winding roll 106 adjacent only the low friction surfaces 136, when low friction surfaces 136 are employed. The web separation bar 124 accelerates to a velocity at least equal to that of the web adjacent the web separation bar 124 at the time of separation. In some embodiments, the web separation bar 124 is accelerated through rotation. The web separation bar 124 can be accelerated through any angle sufficient to generate any velocity at least equal to that of the velocity of the web 102 adjacent the web separation bar 124 at the time of separation. In some embodiments, the web separation bar 124 can be accelerated through 270° of rotation; however other angles through which the web separation bar 124 is accelerated are possible and fall within the spirit and scope of the present invention. By way of example only, the web separation bar 124 can be accelerated to a velocity at least 100% of that of the web adjacent the web separation bar 124. In other embodiments, the web separation bar 124 can be accelerated to a velocity at least 125% of that of the web adjacent the web separation bar 124. In still other embodiments, the web separation bar 124 can be accelerated to a velocity at least 150% of that of the web adjacent the web separation bar 124. However, excellent results can often be achieved by accelerating the web separation bar 124 to a velocity at least 130% of the web adjacent the web separation bar 124. Still, other web separation bar velocities can be used, each falling within the spirit and scope of the present invention.

In some embodiments of the present invention, the web separation bar 124 is timed to contact the web 102 at a position between perforations 109, when a perforated web 102 is used. At the point of contact with the web separation bar 124, the web 102 adjacent the web separation bar 124 is rapidly accelerated to the web separation bar speed and slips on the first winding roll 106 due to the high coefficient of friction between the web separation bar 124 and the web 102. The velocity of the web 102 adjacent the first winding roll 106 and the velocity of a point on the surface of the web separation bar 124 can be the same or substantially the same for a fraction of a second to perform the functions of separating the web as described in greater detail below. However, this amount of time can be longer depending upon the speed of the first winding roll 106, the web 102, and the web separation bar 124 (i.e., with slower speeds of these elements). The amount of time these velocities are the same will typically depend at least partially upon the interference between the web separation bar 124 and the roll 106 and the respective velocities of the bar 124 and the roll 106. The contact point or line between the web separation bar 124 and the web 102 adjacent the first winding roll 106 can be referred to as a web control point 152 in which the velocity of the web is positively controlled and known. In FIGS. 1, 2 and 4–13, the web control point 152 is shown as a region within which the web control point 152 will be located. Tension in the web 102 between the web separation bar 124 and the core 122 increases above the tensile strength of a perforation 109 in the web 102.

Because the web separation bar 124 is close to the core 122 when the web separation bar 124 contacts the web 102, only one perforation 109 exists between the web separation bar 124 and the core 122 in some embodiments. In other embodiments, more than one perforation 109 can exist in the area between the web separation bar 124 and the core 122. Locating at least one perforation 109 in this area of high tension helps ensure that the web 102 will separate on the at least one desired perforation 109, unlike some winders that include a web separator 125 operating at a speed slower than that of a portion of the web adjacent the first winding roll 106. This controlled separation of the web 102 helps guarantee that each log 112 has a desired number of sheets or has a more accurate sheet count, substantially reducing costs of surplus sheets commonly resulting from operation of prior art devices.

In some embodiments of the present invention, the core support plate 110 comprises aluminum. Other materials can be employed for the core support plate, including without limitation steel, ultra-high molecular weight poly(ethylene), or any other material capable of supporting a core 122 or mandrel as it approaches the web 102. One or more core support plates 110 can be used in the present invention. Multiple core support plates 110 are used in the illustrated embodiments, as shown in FIG. 3, but only one is shown in FIGS. 1, 2 and 4–13. In the illustrated embodiments, the rewinder 100 has multiple core support plates 110 that are curved, the set of which extends in at least part of the rewinder 100. The multiple core support plates 110 are spaced apart sufficiently to permit one or more web separation fingers 130 to pass between adjacent plates 110 (FIG. 3). In some embodiments, the curve of the core support plate 110 follows a portion of the first winding roll 106 concentrically and in some cases extends from the location where cores 122 are inserted into the winding area 101 to the second winding roll 116. In some embodiments, as the core 122 is inserted onto the core support plate 110, the core 122 is driven by the first winding roll 106 while rolling along the core support plate 110 toward the winding nip 114. In other embodiments, the core 122 rolls freely along the core support plate 110. In still other embodiments, the core support plate 110 takes a different form altogether and the core 122 is brought to the vicinity of the web 102 by different devices, as discussed below in greater detail. Thus, when the core 122 rolls along the core support plate 110 while being driven by the first winding roll 106, the average velocity of the core 122 along the core support plate 110 is approximately 50% of the velocity of the web 102 adjacent the first winding roll 106. However, when other forms of a core support plate 110 are employed, the core 122 can move toward or adjacent the web 102 at other velocities or can approach the web 102 by other devices.

In some embodiments, as shown in FIGS. 1, 2 and 6–13, the distance between the core support plate 110 and the surface of the first winding roll 106 is less than the diameter of the cores 122, helping to provide proper alignment of the core 122 as it proceeds along the core support plate 110 toward the winding nip 114 and causing the core 122 to deflect slightly, in turn, providing pressure between the core 122 and the web 102 adjacent the first winding roll 106. With continued reference to the illustrated embodiments, this pinching action between the core 122 and the web 102 forces the web 102 against the high friction surfaces 134 of the first winding roll 106. Forcing the web 102 against the high friction surfaces 134 helps assure that the velocity of the web 102 at the point of contact with the core 122 will be the same or substantially the same as the velocity of a point on the surface of the first winding roll 106 adjacent the web 102. The contact point or line between the core 122 and the web 102 adjacent the first winding roll 106 can be defined as a web control point 150 in which the velocity of the web 102 is positively controlled and known. In FIGS. 1, 2 and 4–13, the web control point 150 is shown as a region within which the web control point 150 can be located.

However, in some embodiments of the present invention, the core 122 does not press against the first winding roll 106 (with the web 102 therebetween) with sufficient force to define the web control point 150. In other words, the web 102 is not necessarily sufficiently retained at the location of the core 122 to define a location where the speed of the web 102 is the same or substantially the same as that of the first winding roll 106. Accordingly, in some embodiments and/or for a period of time or movement of the core, there need not necessarily be a web control point 150 at the core 122. In these embodiments, it is not necessary for the core 122 to press against the web 102 with the force described above, because the amount of web wrap around the curved surface of the first winding roll 106 generates sufficient tension in the web 102 to separate the web 102 along a row of perforations 109 lying upstream of the point or line of contact between the web separation bar 124 and the web 102. Furthermore, by employing embodiments in which a web control point 150 is not necessary, lighter cores 122 can be used in the rewinder 100, and/or the cores 122 used in the rewinder 100 do not need to be compressed as much or be able to withstand as great of force while proceeding toward the winding nip 114.

In some embodiments of the present invention, there are two web control points 150, 152 in this rewinding process: one web control point 150 being the contact between the core 122 and the web 102 adjacent the first winding roll 106, and another web control point 152 being the contact between the web separation bar 124 and the web 102 adjacent the first winding roll 106. The web is stretched in the area between the two control points 150, 152. The amount of stretch is determined by the relative velocity difference between the two web control points 150, 152 and the duration of contact at the web separation bar web control point 152. The combination of velocity difference and contact duration is enough to rupture the perforation 109 located in this high-tension zone between the web control points 150, 152.

In some webs 102 employed in the present invention, web stretch and perforation bond strength can be highly variable. In some embodiments of the present invention, different operating conditions can be allowed by making both the relative velocity and the contact duration adjustable, helping the rewinder 100 accommodate a wide range of web materials. The web separation bar 124, the conveyor 115 and the core inserter 111 can be driven by one or more of a number of driving devices or actuators, including without limitation programmable electric, hydraulic, or pneumatic motors, solenoids, linear actuators, and the like, driven directly or indirectly via belts and pulleys, chains and sprockets, one or more gears, and any other driving device or actuator capable of facilitating the timing of the web separation bar 124, the conveyor 115 and the core inserter 111 and helping to ensure the presence of the desired number of perforations 109 in the zone between the two web control points 150, 152.

Figure 4:
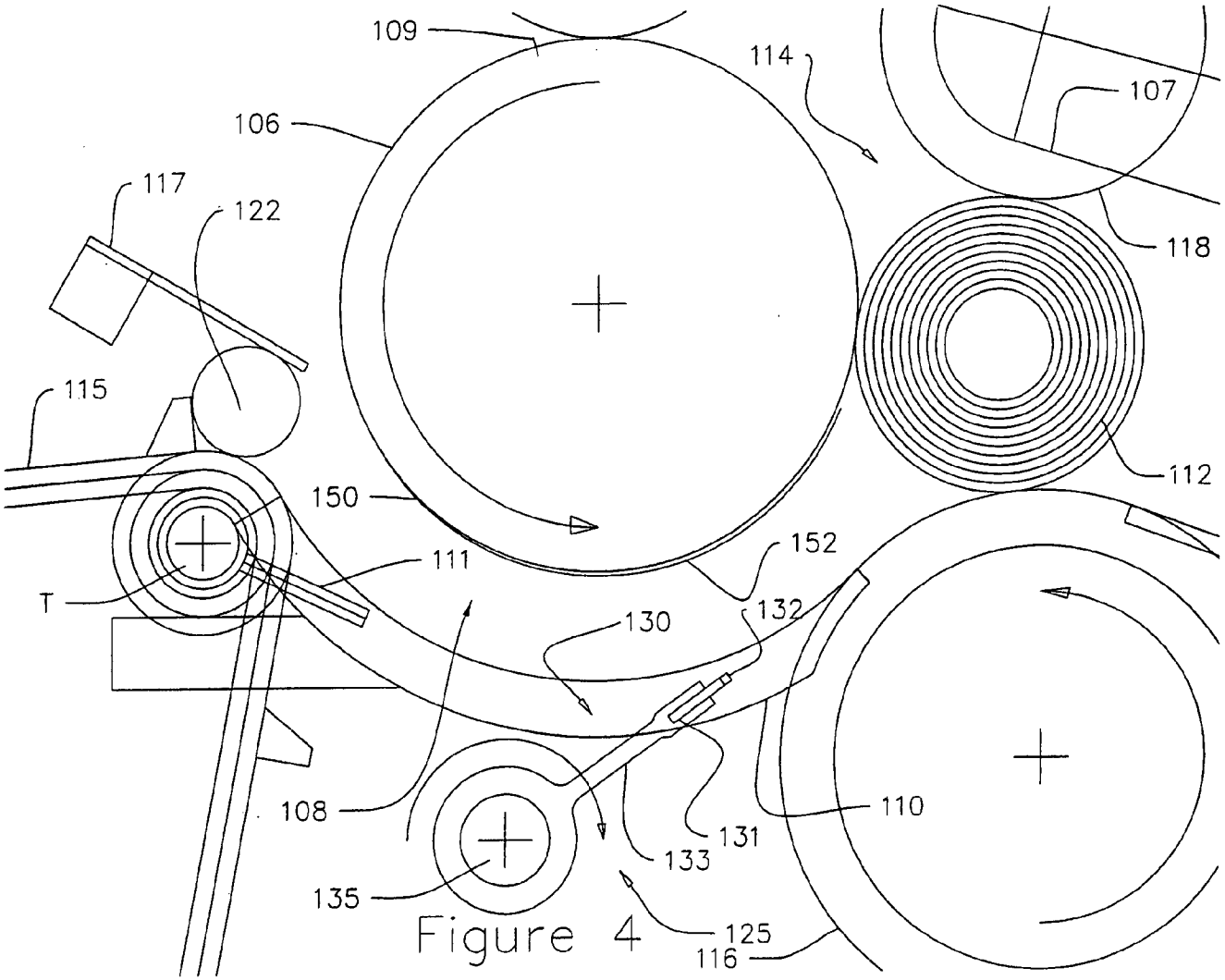
FIGS. 4–11 show a detail view of the winding area of FIG. 2 and the progression of events that occur in the winding area of the rewinder as a core is inserted onto the core support surface and the web is separated and wound around the core.

FIGS. 4–11 are detailed views of the exemplary rewinder 100 illustrated in FIGS. 1–3, showing the progression of events in the winding area 101. FIG. 4 shows a log 112 being wound in the winding nip 114 between the first winding roll 106, the second winding roll 116, and the rider roll 118. A core 122 is positioned on the chain conveyor 115 near the entrance to the throat 108, between the first winding roll 106 and the core support plates 110. The conveyor 1115 and core inserter 111 can be timed and the core 122 restrained from entering the throat 108 until appropriate in a number of ways, including without limitation a plate restraint 117 comprised of a sheet of material contacting the core 122 from the side, below or above (i.e. as shown in FIGS. 1, 2, 4–11) that helps restrain the core 122 due to the orientation and rigidity of the plate; a door that slides, swings, rotates, or rises into position in front of the core 122; a fence made up of a plurality of rods, pegs or plates that is oriented above, below, or beside the core 122 and slides, swings, rotates, rises up, or otherwise moves into position in front of the core 122; and any other barricading structure or device that helps restrain the core 122 from entering the throat 108 until the appropriate time. As illustrated in FIG. 4, the core 122, complete with adhesive in some embodiments, is trapped between the chain conveyor 115 and the plate restraint 1117, located above the core 122 in the illustrated embodiments. A row of perforations 109 is shown just coming onto the first winding roll 106. The web separation bar 124, the conveyor 115 and the core inserter 1111 are about to begin moving to initiate the separation and core insertion processes.

FIG. 5 shows that the log 112 has started to move away from the first winding roll 106, initiating the discharge process. This movement can be the result of slowing down the second winding roll 116 relative to the first winding roll 106, speeding up the first winding roll 106 relative to the second winding roll 116, or both. The web separation bar 124 has accelerated through 270° of rotation from rest (as shown in FIG. 4) to a tip velocity of 130% of the velocity of the web 102 adjacent the first winding roll 106. The perforation 109 has traveled around the first winding roll 106 to a position close to the core 122. The core inserter 111 is pushing the core 122 out from under the plate restraint 117, toward the throat 108 and onto the core support plates 110. In some embodiments, the core inserter 111 accelerates the core 122 to approximately 50% of the velocity of the web 102 adjacent the first winding roll 106. The core 122 then travels along the core support plates 110 at a velocity approximately 50% of the velocity of the web adjacent the first winding roll 106, as explained above.

FIG. 6 shows the log 112 continuing to move away from the first winding roll 106. The core 122 has been inserted between the first winding roll 106 and the core support plates 110, thereby forming the web control point 150 as explained above. The web separation finger tips 132 have passed through the core support plates 110 to an area between the first winding roll 106 and the core support plates 110. The core inserter 111 and the web separation bar 124 have been timed relative to the perforation system 104 to place a single row of perforations 109 between the core 122 and web separation bar 124 adjacent the first winding roll 106.

Figure 7:
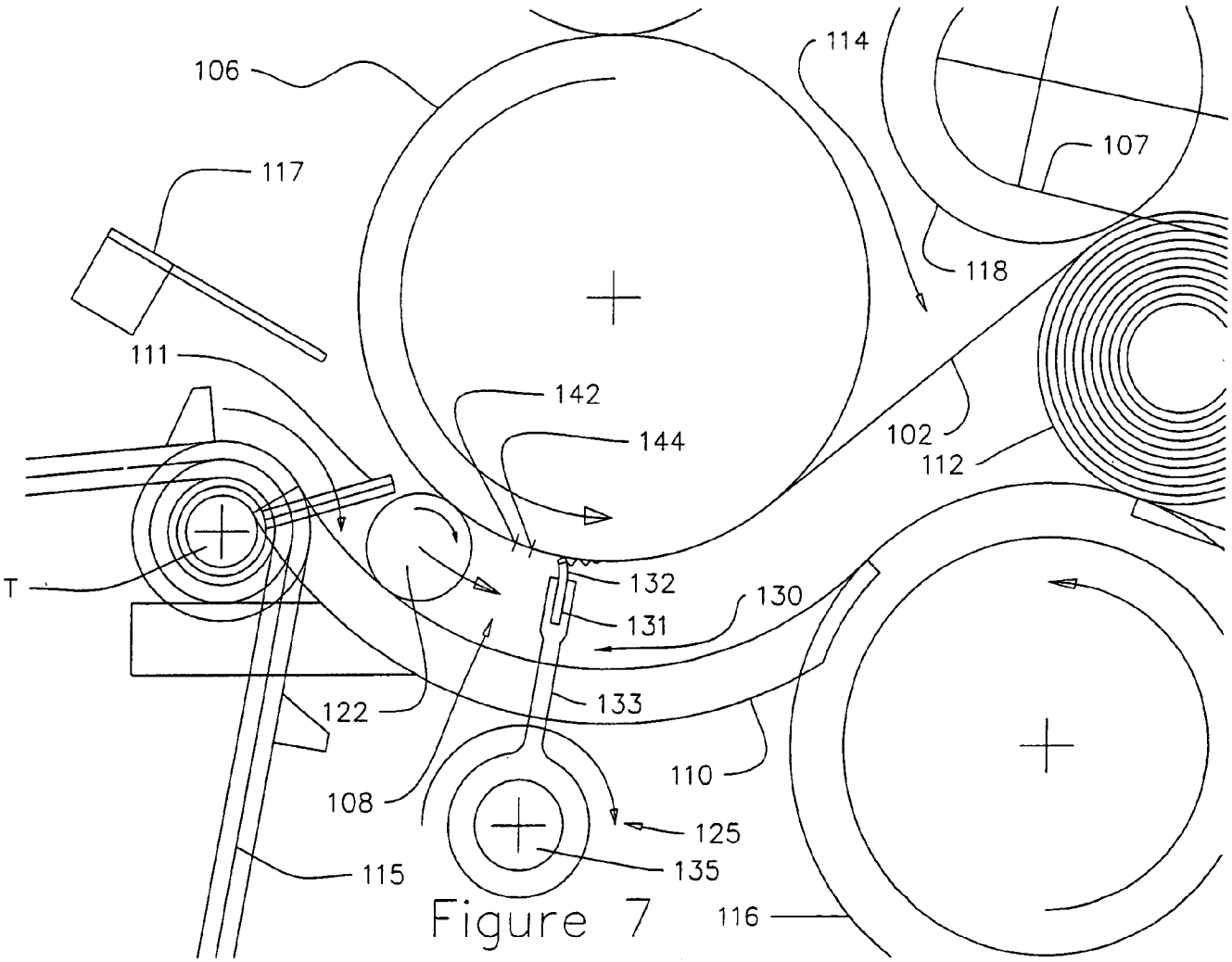

FIG. 7 shows the log 112 moved away from the first winding roll 106 enough to allow the rider roll 118 to drop toward the second winding roll 116. The core 122 is driven by the first winding roll 106 and is rolling along the core support plates 110. The separation bar 124 is in contact with the web 102 adjacent the low friction surfaces 136 of the first winding roll 106. The web 102 at the web control point 152 is therefore rapidly accelerated to the velocity of the web separation bar 124. This acceleration of the web 102 causes the web 102 to become slack downstream of the web separation bar 124 and to become taut upstream of the web separation bar 124. Specifically, the web 102 stretches in the zone between the two web control points 150, 152, causing the web 102 to rupture into a leading edge 142 and a trailing edge 144 along the properly positioned row of perforations 109 located between the two web control points 150, 152.

Figure 8:
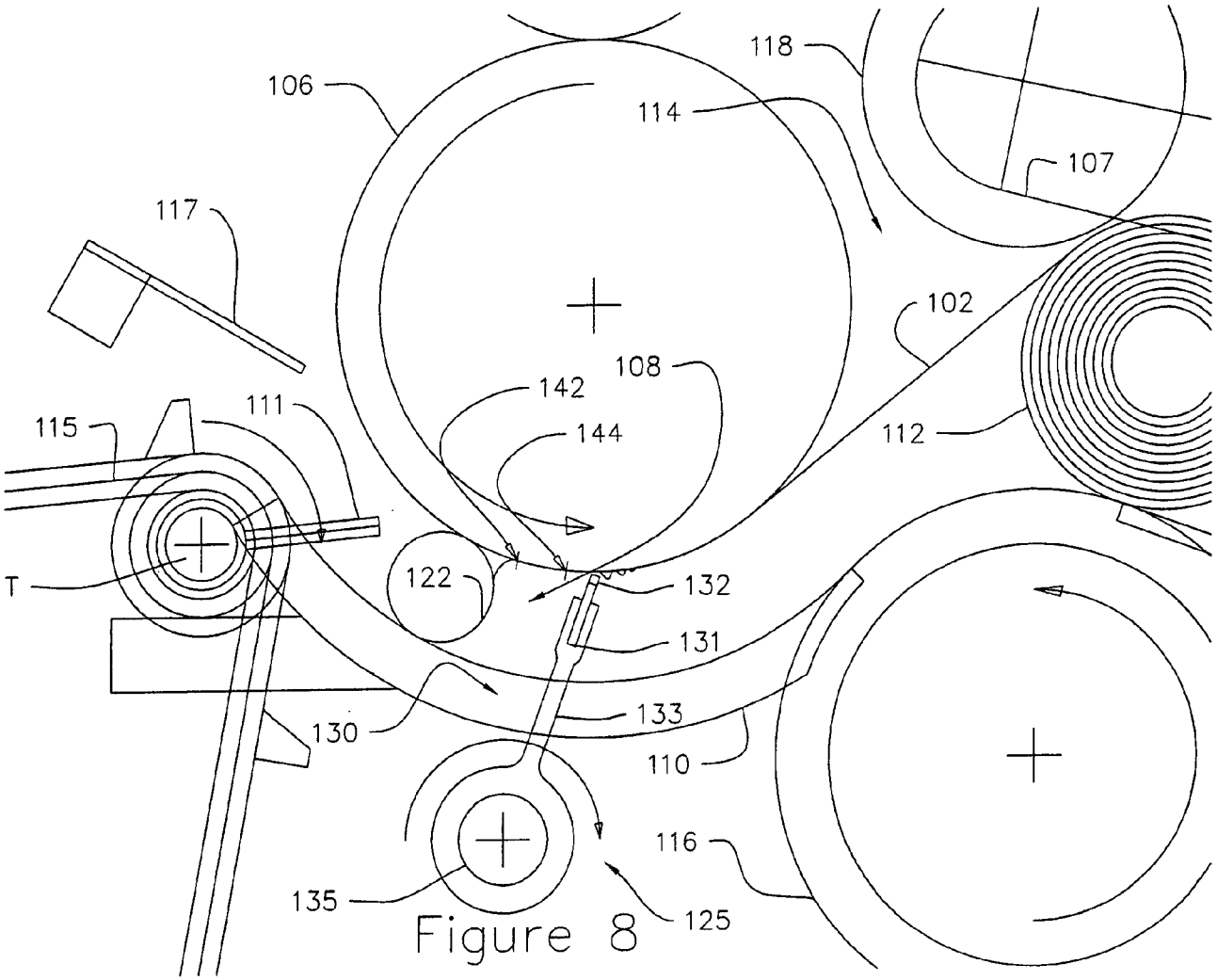

FIG. 8 demonstrates the transfer of the leading edge 142 of the ruptured web 102 to the core 122. In some cases, and depending upon the speed of the core 122 and the distance between the core 122 and the leading edge 142 of the ruptured web 102, a short, controlled fold-back of the web 102 can be formed on the core 122.

Figure 9:
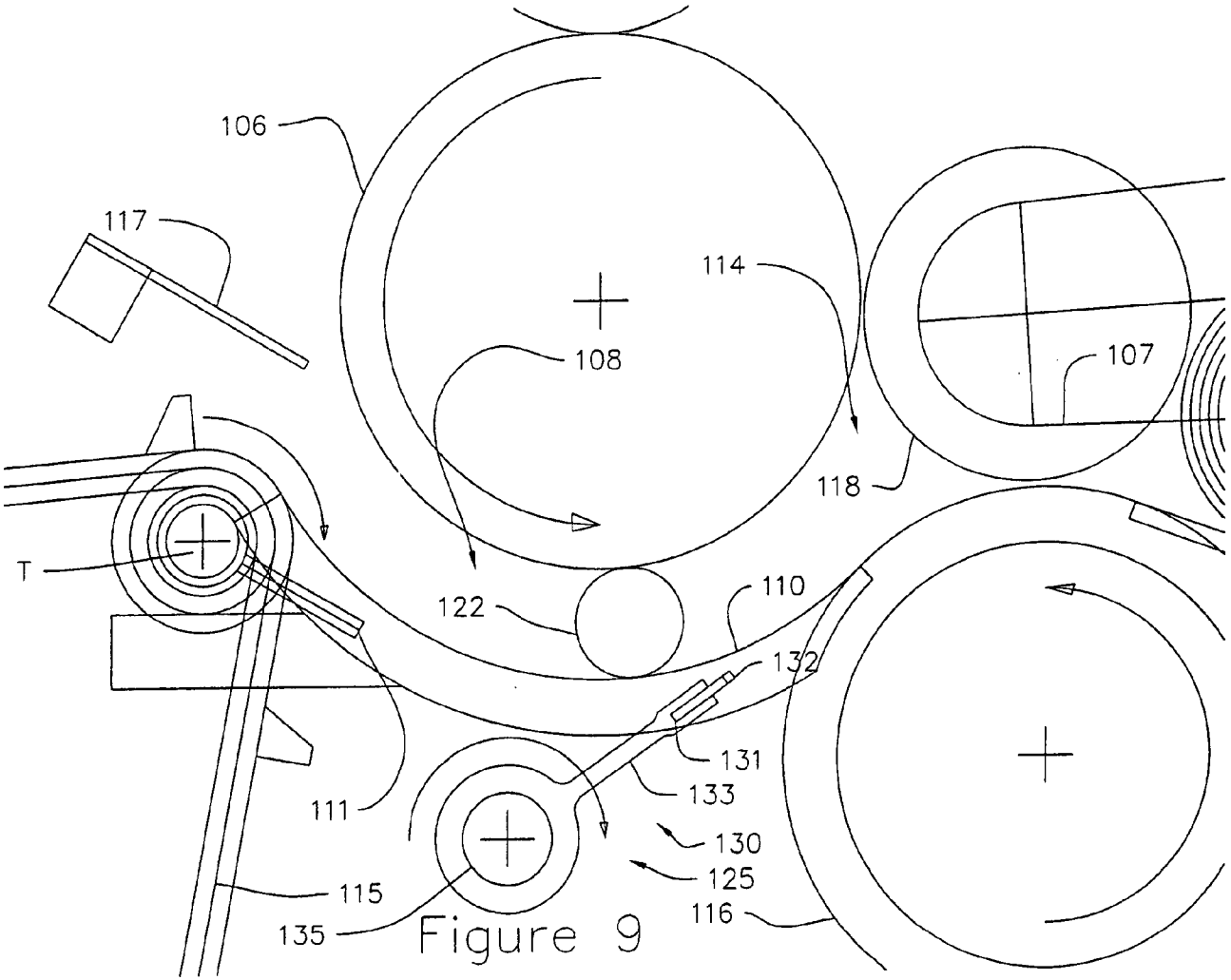

FIG. 9 shows the web separator 125 moving out of the core path and out of the area between the core support plates 110 and the first winding roll 106. The core 122 is moving toward the winding nip 114 between the first winding roll 106, the second winding roll 116 and the rider roll 118. The rider roll 118 has dropped down close to the second winding roll 116.

Figure 10:
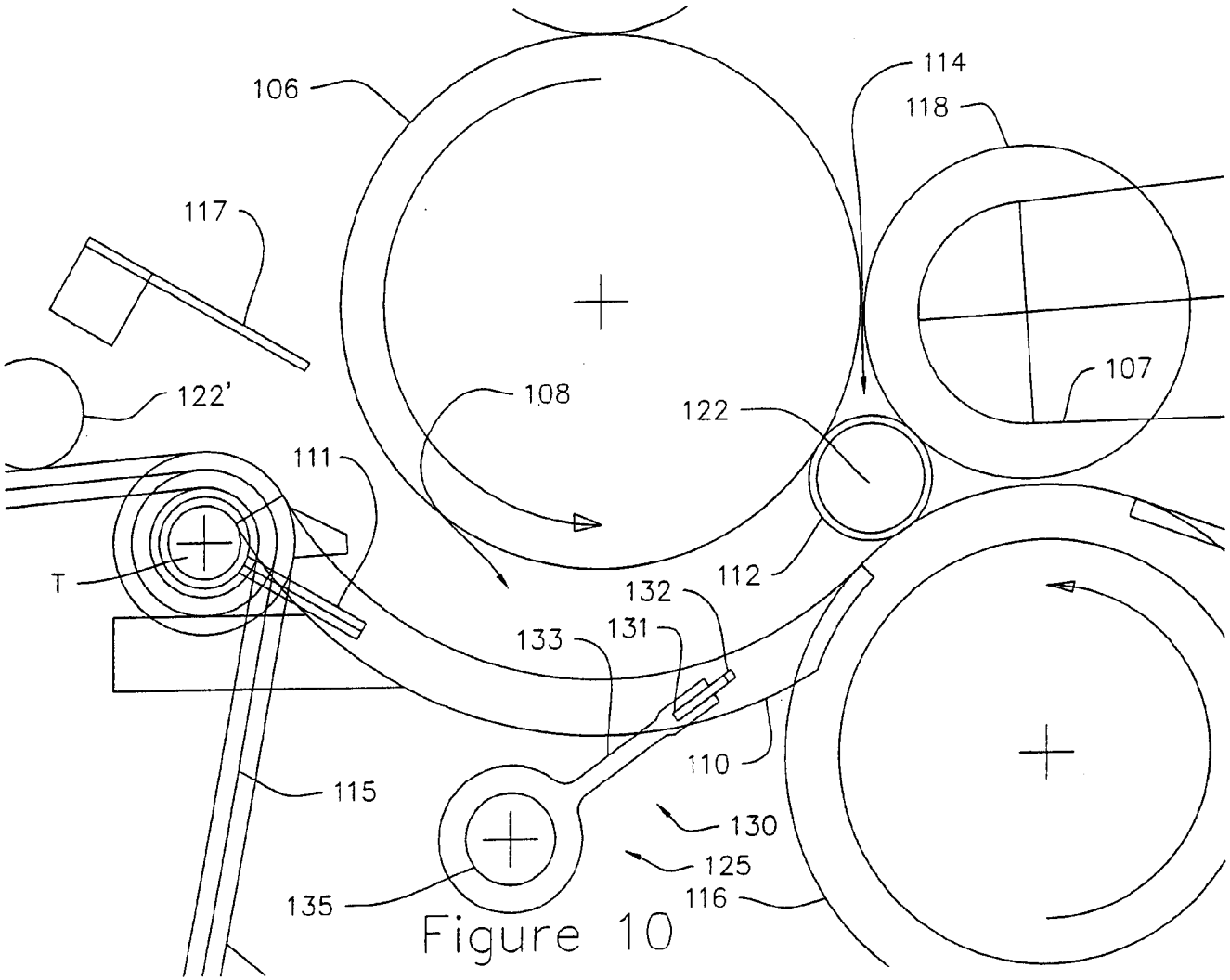

FIG. 10 shows a later stage in the winding process, with the core 122 in contact with the first winding roll 106, the second winding roll 116 and the rider roll 118.

Figure 11:
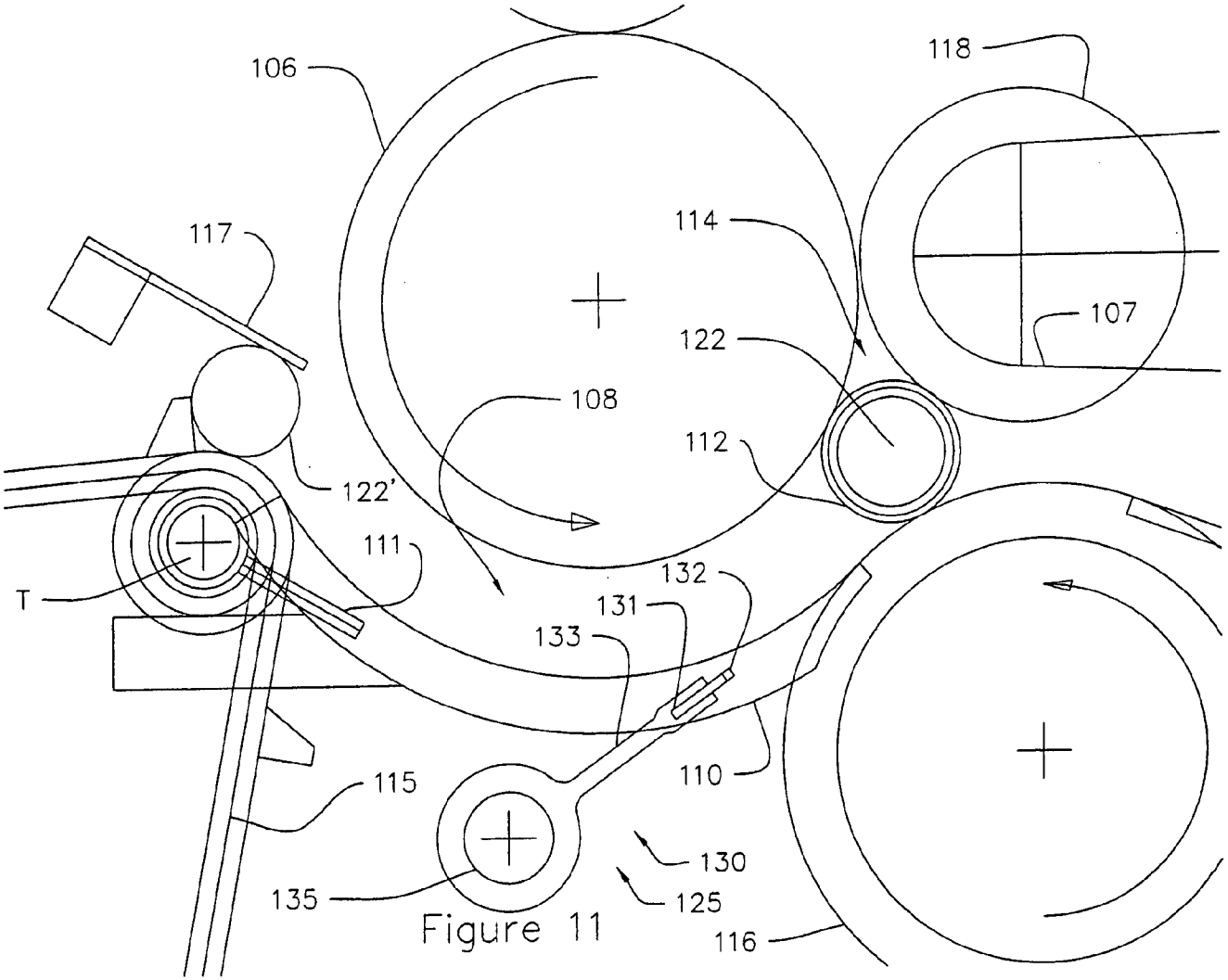

Finally, as shown in FIG. 11, the rider roll 118 begins to move upward as the new winding log 112' increases in diameter. The conveyor 115 has indexed a new core 122' into position for the next core insertion step. Winding can continue until the log 112' nears completion, at which time the above-described process can repeat, beginning as depicted in FIG. 4.

As best illustrated in FIGS. 1 and 2, a conveyor 115, a core inserter 111 and a plurality of core support plates 110 are used to insert and guide the cores 122 into the winding nip 114. However, cores 122 can instead be inserted and/or guided to a winding nip (e.g. a two- or three-roll winding nip) via other insertion devices that are well within the spirit and scope of the present invention. For example, one or more fingers or other protrusions can extend from a ring that, when rotated, picks up cores 122 and transports them toward the winding nip 114; a pulley system that transports cores to a location where a lever, pressurized air jet, vacuum system or other mechanism directs the core 122 into the winding nip 114; an elevating platform that brings cores 122 toward a desired position where a lever, pressurized air jet, vacuum system or other mechanism directs cores 122 into the winding nip 114; one or more ramps, rails, ducts, beds, gutters and the like that guide cores 122 to the winding nip 114 via gravity, a pressurized air jet, a vacuum system, or other mechanism; a series of valves within or along a ramp, rail, duct, bed, gutter and the like that indexes and advances cores 122 to the winding nip 114 by incorporating pushers or pressure gradients to force cores 122 through the valves or timers to actuate the opening and closing of the valves to allow cores 122 to move through the valves at appropriate times; a rotatable or swinging arm that transports cores 122 to the winding nip 114; and any other inserting and guiding device or system known to those skilled in the art.

In some embodiments of the present invention, the core inserter 111 comprises one or more paddles that rotate about an axis T to push the core 122 out from under the plate restraint 117 and into the throat 108 as shown in FIGS. 1, 2 and 4–13. However, in other embodiments, the core inserter 111 does not rotate about an axis, but rather follows the conveying motion of the conveyor 115, moves along an arcuate path independent from but adjacent the conveyor 115, moves along a straight path independent from but adjacent the conveyor 115, follows an aperture in a cam member, and/or follows any other path or moves in any other manner for moving the core 122 as described above. In some embodiments, the core inserter 111 is comprised of one or more rods, plates, fingers and/or any other element capable of pushing the core 122 into the throat 108. In other embodiments, the core inserter 111 has one or more curved or bowed surfaces, is spherical, or has a cross-section that is trapezoidal, triangular, round, diamond-shaped, or has any other shape or cross-sectional shape. In still other embodiments, the core inserter 111 does not push the core 122 by contacting the core 122 along a longer edge of the core inserter 111, but rather pushes the core 122 into the throat 108 by poking the core 122 with a shorter end of the inserter 111, or pushes the core 122 in any other manner known to those skilled in the art. Accordingly, these and any other devices or structures capable of transporting and inserting cores 122 into the winding nip 114 can be employed without departing from the present invention. However, regardless of the device or system that transports cores 122 to the winding nip 114, the web separation bar 124 of the present invention can still be employed as described above to separate the web downstream of the core 122 being inserted.

The core support surface 110, if employed, can be any surface along which cores 122 can be guided toward the winding nip 114. For example, the core support surface 110 can be defined by one or more sides, edges or other surfaces, of one or more plates, rods, bars or other elements extending any distance past and/or around the first winding roll, can be a sheet of material, a grid or a mesh structure, a frame of multiple elements and the like. The core support surface 110 illustrated in FIGS. 1–13 is curved, but the core support surface 110 can have a number of different forms, including without limitation flat, semicircular, and any form capable of transporting cores 122 to the web 102. In some embodiments, the core support surface 110 is comprised of a plurality of rods with rectangular cross-sections, but the core support surface 110 can be a number of different shapes; for example, the core support surface 110 can be a solid sheet or plurality of rods, bars, plates or other elements with an ellipsoidal shape, square cross-section, circular cross-section, triangular cross-section, trapezoidal cross-section, and any other shape or cross-section known to those skilled in the art. In the embodiments illustrated in FIGS. 1–13, the core support surface 110 is stationary, but the core support surface 110 can be movable; that is, movable only when actuated, movable by rotation, movable by swinging about a hinge, movable by sliding along a straight or arcuate path, and movable by any other devices known to those skilled in the art. In still other embodiments, the core support surface 110 can be comprised of a plurality of rods transversely spaced an equal distance apart; however, the core support surface 110 can be comprised of a plurality of sheets, plates, rods, bars or other elements and can have a number of different schemes for spacing these elements; for example, the elements can be spaced longitudinally, transversely, equally, unequally, randomly, and follow any other scheme or pattern of spacing without departing from the present invention. In yet other embodiments, the core support surface 110 is comprised of a plurality of rods oriented longitudinally (as shown in FIGS. 1–13 and especially FIG. 3), but the core support surface 110 can be oriented with respect to the advancing web in a number of ways, including without limitation being oriented longitudinally, transversely, partially transversely and partially longitudinally, radially, and be oriented in any other manner known to those skilled in the art. In short, the core support surface 110 can comprise any other surface or plurality of surfaces capable of guiding cores 122 toward the winding nip 114.

Figure 12:
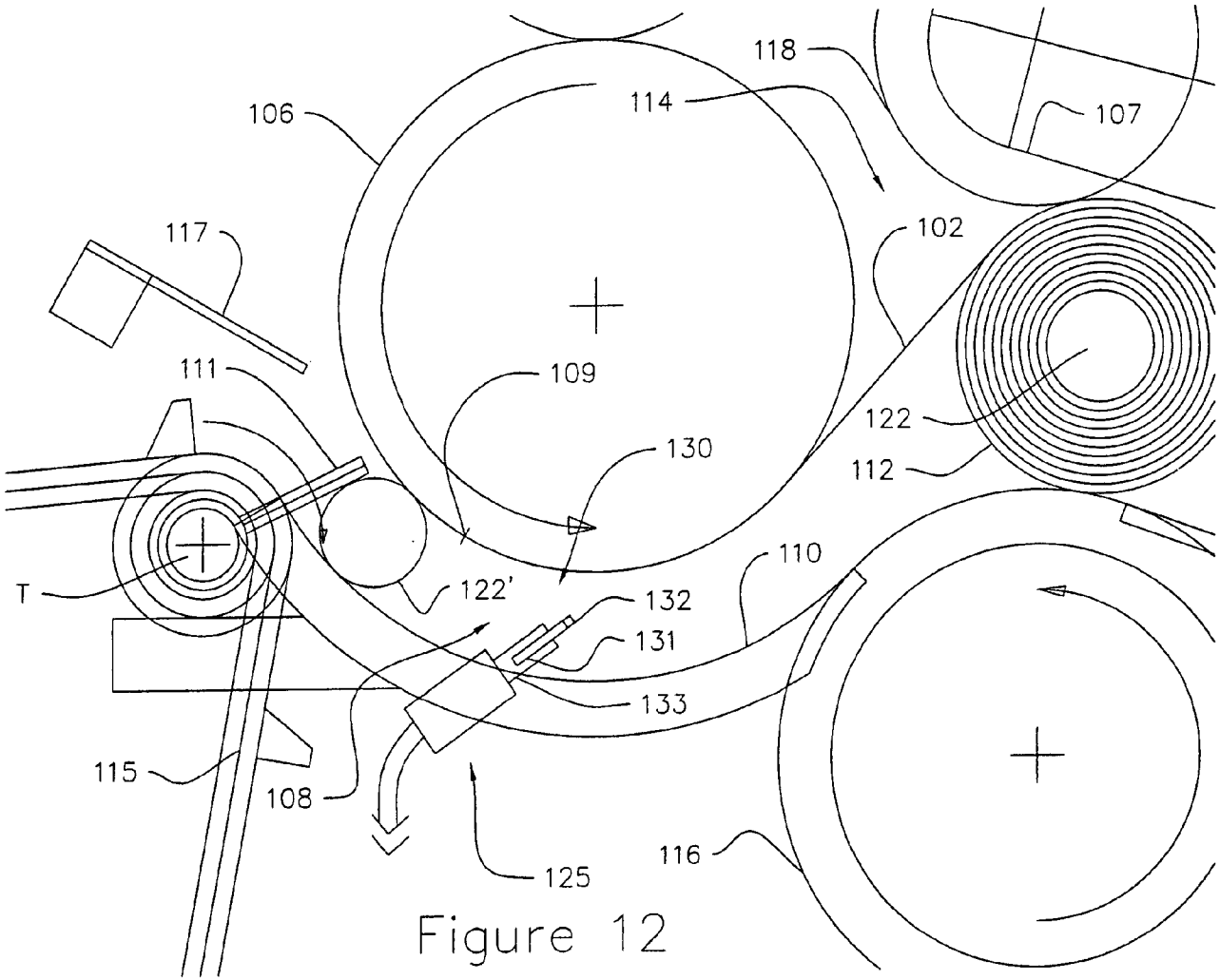
FIG. 12 shows a detail view of the winding area of FIG. 2 according to a second embodiment of the web separator for the present invention.
Figure 13:
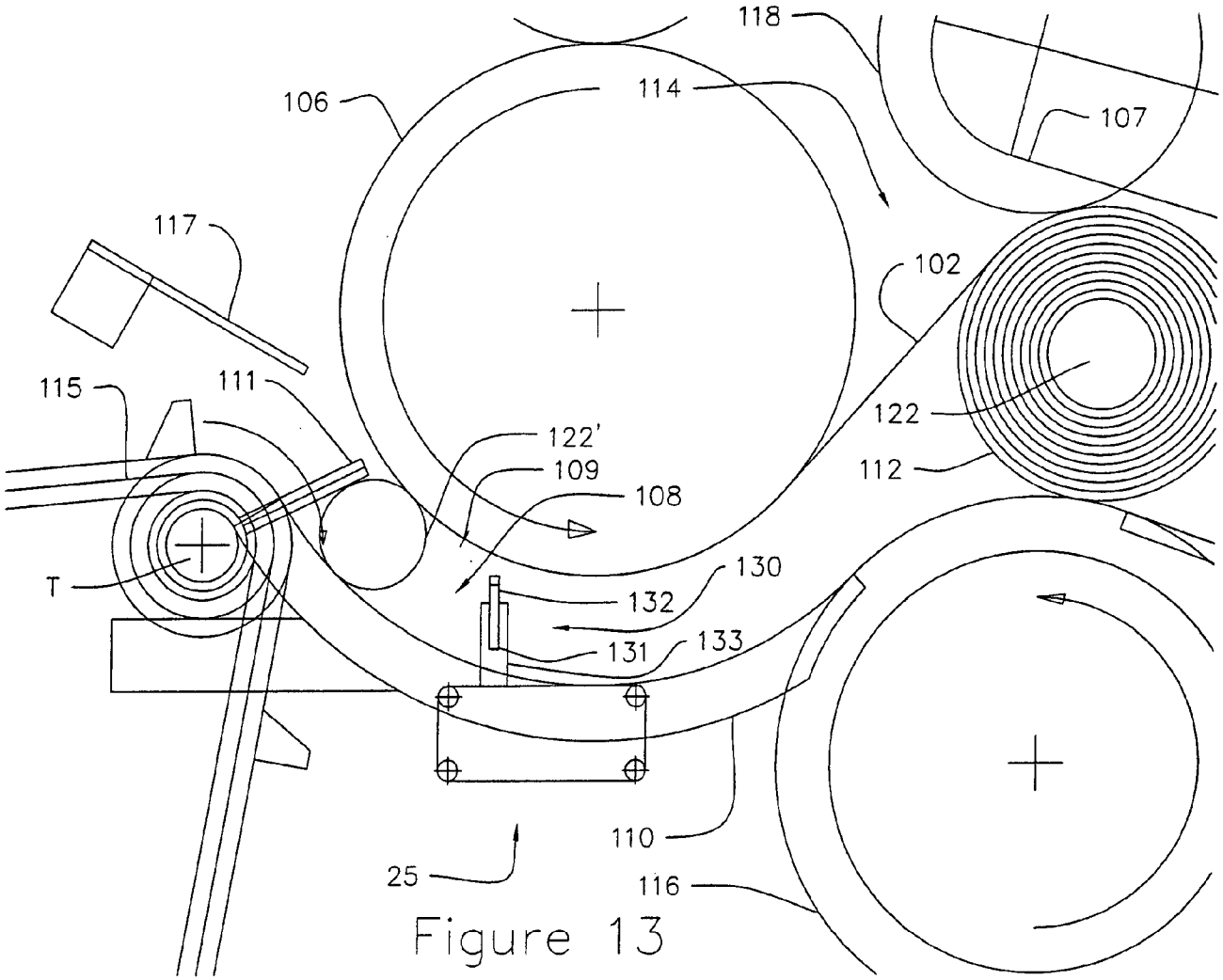
FIG. 13 shows a detail view of the winding area of FIG. 2 according to a third embodiment of the web separator for the present invention.

Although in the embodiment illustrated in FIGS. 1–11, the web separator 125 is elongated, rotatable about an axis and comprised of a plurality of web separation fingers 130 with resilient tips 132, the web separator 125 can take a number of different forms while still being movable toward the web 102 at a velocity at least equal to that of a portion of the web 102 adjacent the web separator 125 at the time of separation for the purpose of contacting and separating the web 102. For example, the web separator 125 comprising one or more web separation fingers 130, bases 133, and/or tips 132 can be mounted to a linear actuator 154 for movement toward the web 102 along a linear path (as shown in FIG. 12), or mounted to a conveying belt 156 equipped with one or more web separation fingers 130, paddles, or other protrustions, bases 133 and/or tips 132 (as shown in FIG. 13). Many types of linear actuators can be employed, including without limitation a solenoid, hydraulic or pneumatic cylinder, magnetic rail, and the like. In the embodiment shown in FIG. 12, the linear actuator 154 is oriented at an angle of approximately 30° with respect to the advancing stream of web 102; however, the linear actuator 154 can be oriented at any possible angle with respect to the web 102 so as to contact and separate the web 102. In the embodiment shown in FIG. 13, the web separator 125 is mounted at 90° with respect to a rectangular-shaped conveying belt 156. However, in other embodiments, the web separator 125 can be mounted to the conveying belt 156 at any angle possible and capable of moving along any path possible as defined by the conveying belt 156, such as triangular, circular and other paths as described above. In other embodiments, the web separator 125 can move toward the web 102 via a combination of devices or actuators, including without limitation the aforementioned devices and actuators.

The embodiments illustrated in FIGS. 1–13 and especially FIGS. 1–3 and 6–8, show the web separator 125 contacting the web 102 against a surface of the first winding roll 106. However, in some embodiments, the web separator 125 presses the web 102 against one or more fingers, plates, spheres, and any other elements against which the web separator 125 can press instead of or in addition to pressing the web 102 against the roll 106.

The embodiment best illustrated in FIG. 3 shows the web separator 125 comprising fingers 130, bases 133, and tips 132 having recesses 138. However, the web separator 125 need not be comprised of a plurality of web separation fingers 130 with resilient tips 132 (whether or not having recesses 138 in the tips to accommodate the high friction surfaces 134 of the first winding roll 106). Furthermore, the web separator 125 can make minor or brief contact with the web 102 sufficient to accelerate the web 102 to the breaking point, without the web 102 being required to slip on a first winding roll 106 in order to separate. In some embodiments, the web separator 125 can instead comprise a plurality of sharp web separation fingers 130, elongated or otherwise, for extension into grooves in the first winding roll 106. In other embodiments, the sharp or otherwise web separation fingers 130 can extend into grooves in any surface adjacent the advancing web 102, whether a winding roll, belt or other surface capable of advancing or supporting the web 102. In still other embodiments, the web separation fingers 130 can be one or more bars, rods, plates, or other elements that press the web 102 against a stationary or moving surface. In yet other embodiments, the sharp or otherwise web separation fingers 130 can merely extend toward, into or through the advancing web 102 to separate the web 102, whether perforated or not, without the use of any first winding surface 106. Such web separation fingers 130 can be sharp or can otherwise act as blades against the web 102 and/or first winding surface 106 in order to cut the web 102, if desired. Additionally, in still other embodiments, the first winding roll 106 can be equipped with rotating blades or protrusions that move toward the web 102 at a velocity at least equal to that of the web 102 to engage the fingers 130 of the web separator 125, the fingers 130 functioning as anvils. Alternatively, the blades of the first winding roll 106 can run near or adjacent the advancing web 102, and the fingers 130 functioning as anvils can move toward the web to contact the blades of the first winding roll 106 at a velocity at least equal to that of the advancing web 102.

Furthermore, the resilient tip 132 of the web separation finger 130 need not rotate or follow a circular path to contact and separate the web 102, but can follow one or more of a number of different paths, as explained above. The web separator 125 can follow any possible path as long as the web separator 125 is movable toward and away from an advancing stream of web at a velocity at least equal to that of the web 102 adjacent the web separator 125 at the time of web separation in order to separate the web 102.

A number of alternative elements and structures can be employed for this purpose. By way of example only, the web separator 125 can comprise a roll adjacent the first winding roll 106 and rotatable about an axis at a speed greater than that of the advancing stream adjacent the web separator 125. Such a roll can be moved in any conventional manner toward the advancing stream of web 102 to separate the web 102. If desired, this roll can comprise one or more strips of resilient or rigid material of high or low friction extending transversely or longitudinally along the roll, or can have a continuous outer surface composed of a resilient or rigid material of high or low friction. In embodiments where the core support surface 110 and first winding roll 106 as depicted in FIGS. 1–13 are employed, this web separation roll 125 can instead be a cylindrical eccentric roll having grooves defining portions of the roll that can pass through the core support surface 110 to contact the web 102. In still other embodiments, the web separator 125 can be a moving belt or wheel with paddles or fingers, or other types of protrusion extending into contact with the web 102 as needed.

In those embodiments in which a core support surface 110 and a web separator 125 are employed, these two devices do not necessarily need to cooperate (i.e. interdigitate; contact one another; move near, past, or through each other; or operate synchronously). These and any other structure capable of separating the web 102 by moving toward the web 102 at a velocity at least equal to that of a portion of the web 102 adjacent the first winding roll 106 can be employed as alternatives for the web separator 125 and, thus, can be employed without departing from the present invention.

The rolls described above can have a number of different structures, as stated above, including without limitation belts, wheels, stationary surfaces, stationary tracks having a plurality of rollers or wheels for conveying material, and any other conveying or supporting structure that performs the function of transporting, supporting, and/or winding the web 102. In some embodiments, the first winding surface 106 has a plurality of alternating longitudinal strips of high friction surfaces 134 and low friction surfaces 136; however, this need not be the case, but rather the first winding surface 106 can have one continuous outer surface of high or low friction including without limitation steel; aluminum; poly(tetrafloroethylene) (PTFE; Teflon®); rubber; emery cloth; wood, natural or otherwise; ultra-high molecular weight poly(ethylene); silicone; and any other surface capable of acting as at least an outer layer on the first winding surface 106 for transporting, supporting and/or winding the web 102. The first winding surface 106 need not transport the web necessarily, but, if employed, provides a surface against which the web separator 125 can press the web 102 for the purpose of separating the web 102. Alternatively, the web 102 can move through the winding area 101 without being directly adjacent any winding surface, in which case the tension in the web 102 is selected to be sufficient for a web separator 125 approaching, contacting and pulling the web 102 at a velocity at least equal to that of the running speed of the web 102 to separate the web 102. Additionally, even if a first winding surface 106 is employed for advancing the web 102, the web separator 125 need not cooperate (i.e. contact; move near, past or through; interdigitate; or operate synchronously) with this surface 106 in order to separate the web 102. Thus, the above and any other structures capable of transporting and winding the web 102 are considered to fall within the spirit and scope of the present invention.

Figure 14:
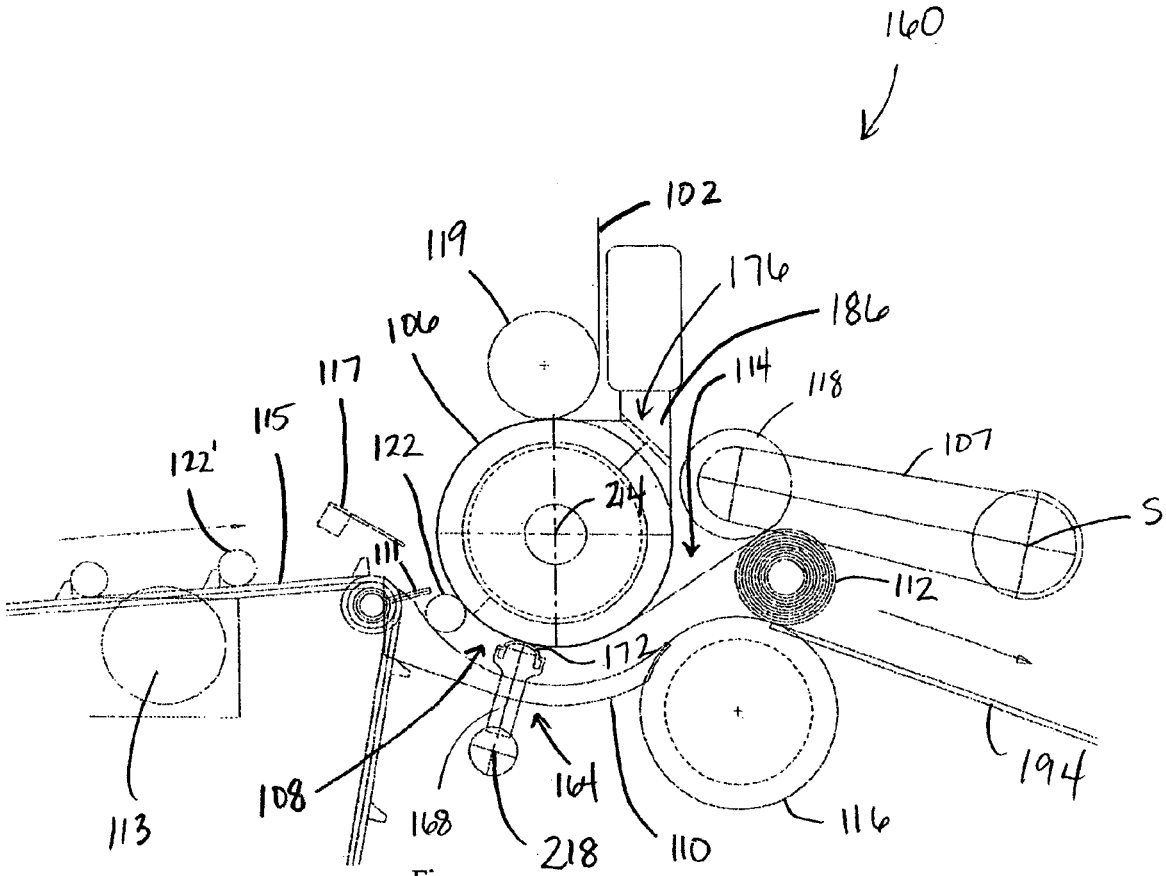
FIG. 14 shows a detail view of another rewinder according to the present invention showing the first and second winding rolls, the rider roll, the core insertion device, the core support surface, and the web separator.

FIG. 14 illustrates another rewinder 160 according to some embodiments of the present invention. Like parts to the rewinder 100 described in detail above are given like reference numerals. The rewinder 160 includes a web separation bar 164 that is movable into contact with the web 102 to separate the web 102. Similar to the web separator discussed above, the web separation bar 164 includes a base 168 and a tip 172 coupled to the base 168. The configuration of the base 168 and the tip 172 will be discussed in detail below. In operation, the web separation bar 164 functions similarly to the web separation bar 124 discussed in detail above to separate the web 102 for rewinding onto a core. The differences in operation will be discussed in detail below, but the steps for inserting a core largely follow those steps discussed above with respect to FIGS. 4–11.

Figure 15:
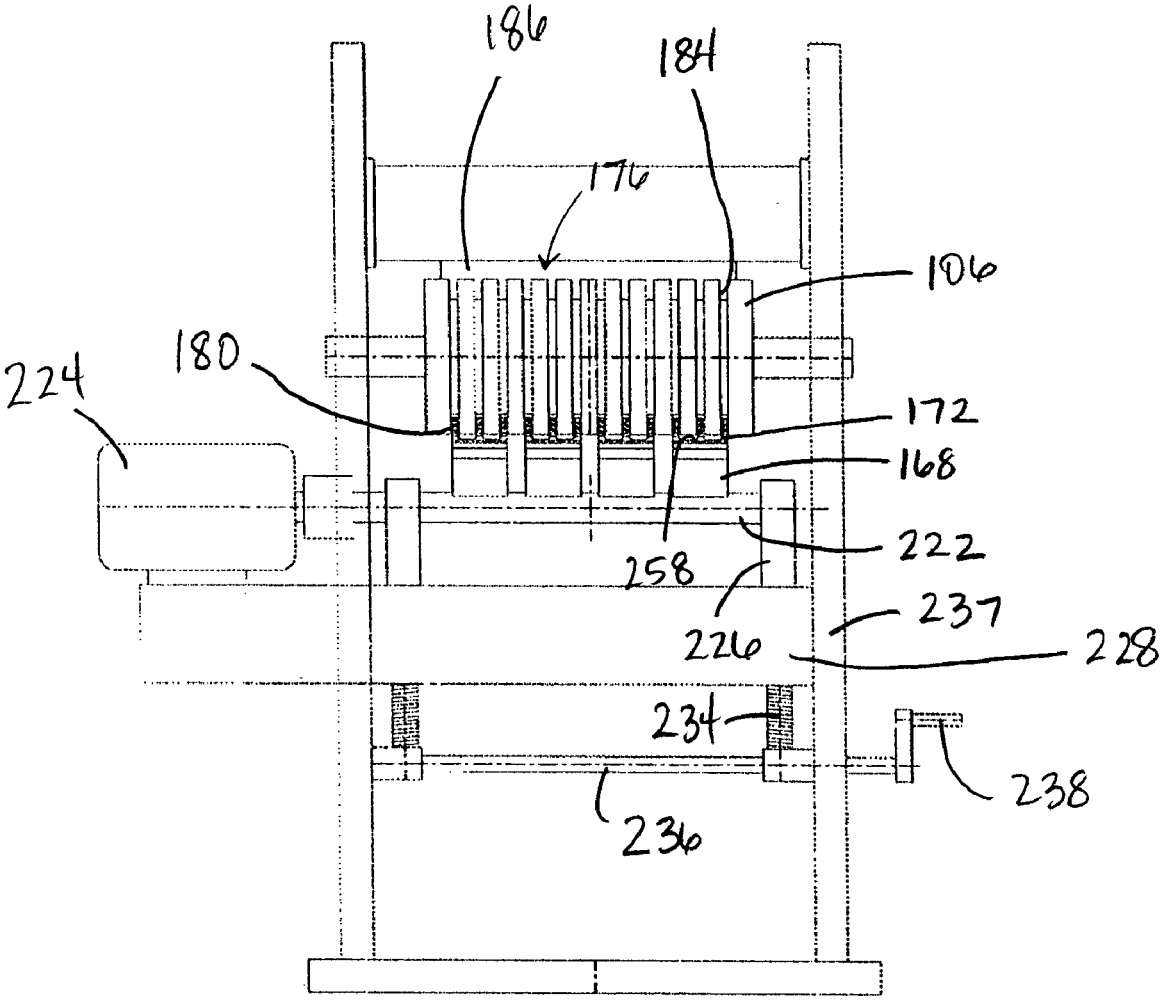
FIG. 15 is a side view of the rewinder of FIG. 14, showing the first winding roll in detail.
Figure 16:
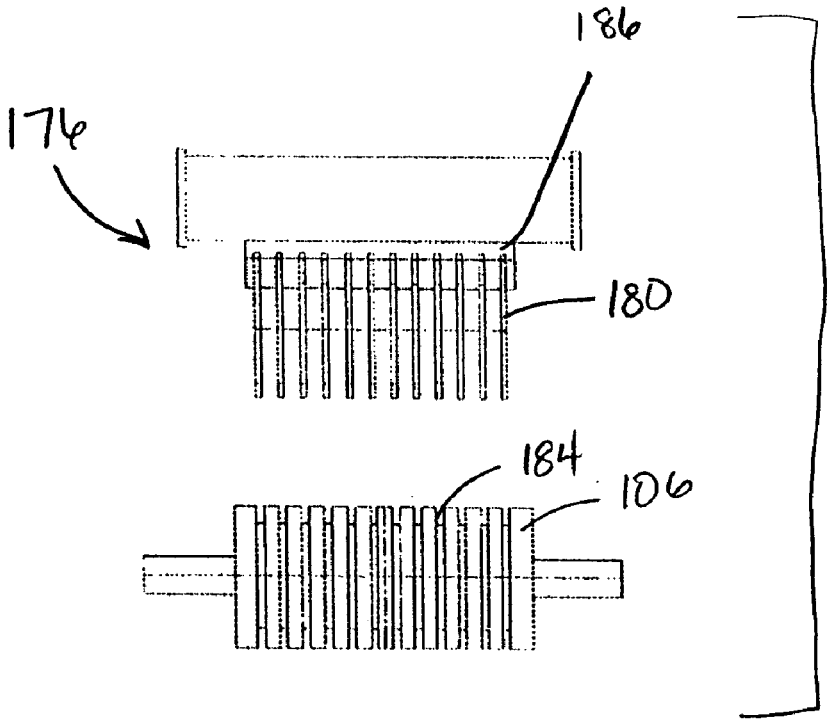
FIG. 16 shows a detail view of the first winding roll and contact finger.
Figure 17:
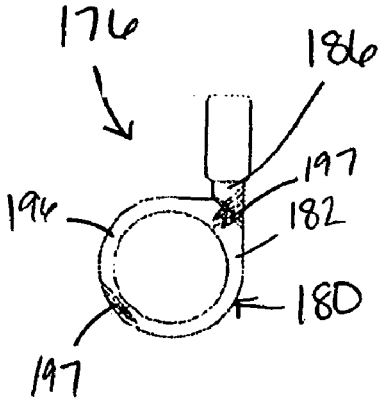
FIG. 17 is a side view of the contact finger.

With further reference to FIGS. 15–17, to further improve the reliability and predictability of web separation, the present invention can have a contact finger assembly 176.

The contact finger assembly 176 includes at least one contact finger 180, at least partially recessed within a respective groove 184 in the first winding roll 106. The grooves 184 in the first winding roll 106 are circumferential, permitting the first winding roll 106 to rotate while the contact fingers 180 remain stationary in the grooves 184.

The contact fingers 180 can be elongated and curved members matching or substantially matching the shape of the first winding roll 106. In some embodiments, the contact fingers 180 are ring-shaped. In other embodiments, only a portion of the contact fingers 180 are curved, and the remaining portions take any desired shape. Each contact finger 180 can present a concave surface to the first winding roll 106. The contact fingers 180 are positioned within their respective grooves 184 to permit free rotation of the first winding roll 106 with respect to the contact fingers 180. A small gap (e.g., 1/16 or 1/32 inch) exists between each contact finger 180 and the bottom and sides of its respective winding roll groove 184 so that the contact fingers 180 are free of contact with the first winding roll 106 (or at least free of obstruction of the upper winding roll's motion).

In some embodiments of the present invention, the contact fingers 180 are shaped to even further improve separation control. As shown in FIG. 17, the fingers 180, in some embodiments, include a first piece 182 and a second piece 196 that are removably coupled together via at least one fastener, such as screw 197. In embodiments where the fingers 180 are mounted to the first winding roll 106 such that the fingers 180 are stationary with respect to the roll 106, the first and second pieces 182, 196 are placed within the grooves 184 of the roll 106 and the screws 197 are tightened, clamping the fingers 180 in place. The fingers 180 extend around the first winding roll 106 and in some embodiments, the contact fingers 180 are concentric with the center of the first winding roll 106. In some embodiments, the outside diameter of the contact fingers 180 is equal to the diameter of the first winding roll 106.

The present invention presses the running web 102 between the web separation bar 164 and the contact fingers 180. The web 102 therefore passes around the first winding roll 106 and over the contact fingers 180 on its way to the winding log 112 (as used herein and in the appended claims, the web 102 described or claimed as being "over" a surface does not preclude the web 102 from being in contact with the surface). Significantly greater control over web separation is possible by controlling contact finger shape and position. The contact fingers 180 provide a low friction surface against which to press the web 102, while the surface of first winding roll 106 is a high friction surface for control of the web 102 as the web 102 passes around the winding roll 106.

In some embodiments, the contact fingers 180 extend in an arc around about at least a majority of the upper winding roll's circumference. In the embodiment of FIGS. 15–18, the contact fingers 180 extend around the entirety of the upper winding roll's circumference. In the illustrated embodiment, the contact fingers 180 are secured against movement from positions within the grooves 184 of the first winding roll 106. Each contact finger 180 in this embodiment preferably extends to a common mounting rod 186, though it is understood that a plate, bar, or other element running substantially the entire length of the first winding roll 106 could also be used, or to a position in which all of the contact fingers 180 are attached together in a conventional manner. Because the contact fingers 180 can be relatively narrow (e.g., less than an inch in width and possibly less than half an inch), this common connection provides strength and stability to the contact fingers 180.

Figure 18:
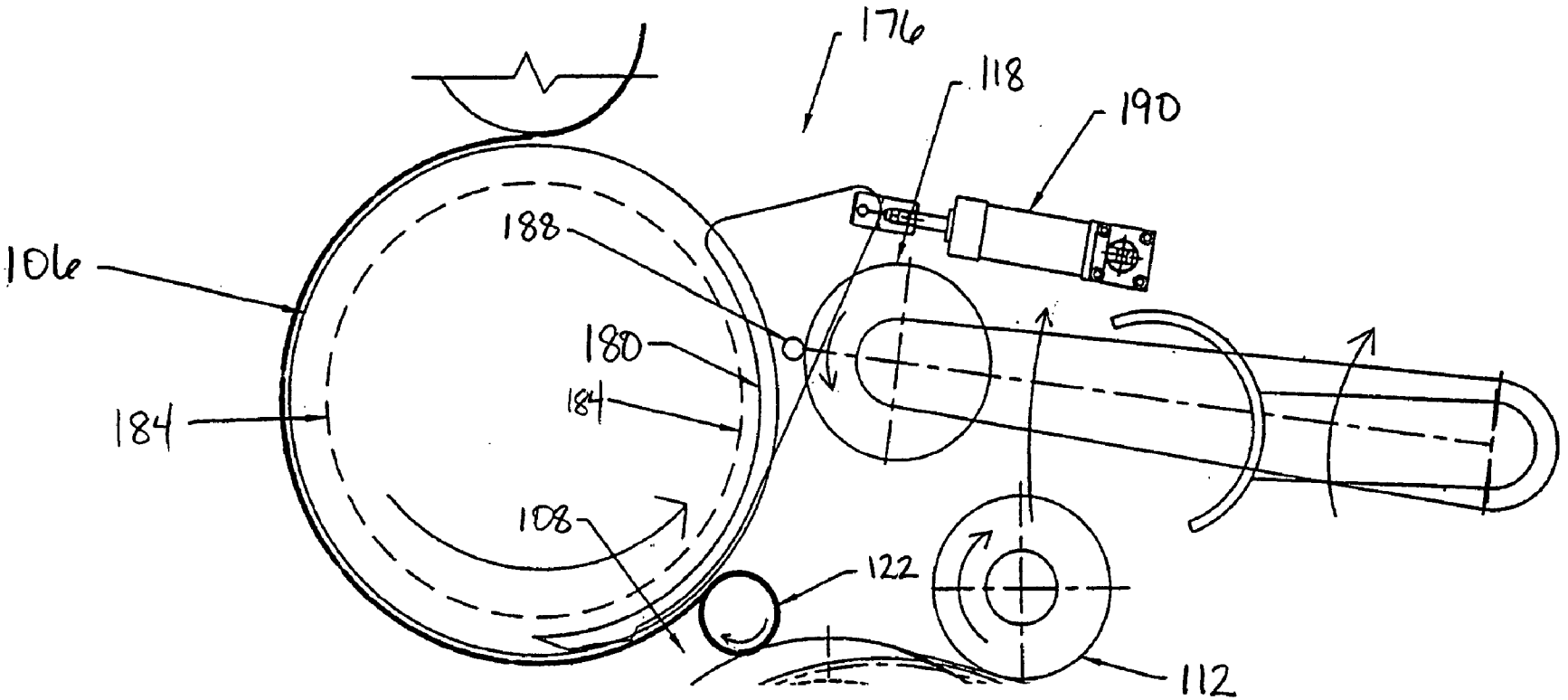
FIG. 18 is a partial view of the rewinder of FIG. 14, illustrating another embodiment of the contact finger.

In another embodiment, as illustrated in FIG. 18, the contact fingers 180 are mounted for radial movement toward and away from the first winding roll 106, moving into and out of the grooves 184. In some embodiments, the contact fingers 180 translate, or pivot and translate into and out of the grooves 184. The contact fingers 180 extend around a portion of the first winding roll 106, and in some embodiments, can extend about approximately 1/3 the circumference of the winding roll 106.

To achieve this movement, the contact fingers 180 can be mounted for rotation about a common pivot point or multiple pivot points. The common pivot point can be the common mounting rod, plate, or bar to which the contact fingers 180 are attached as described above. In the illustrated embodiment, the contact fingers 180 are attached to a pivot rod 188 in a conventional manner, and are each connected in a conventional manner to one or more actuators 190 either directly or by a common connecting member. The actuators 190 can be of any type, such as pneumatic, hydraulic, or electromagnetic actuators, but can instead be replaced by any driving device capable of pivoting the contact fingers 180 about the pivot rod 188 or other suitable pivot. By actuating the actuators 190, the contact fingers 180 pivot about rod 188, thereby moving the ends of the contact fingers 180 substantially radially with respect to the first winding roll 106. The actuators 190 can be connected to a system controller that operates the actuator at timed intervals, in response to one or more sensors detecting the location of the new core 122 or winding log 112, and the like, and can even be operated manually if desired.

The contact fingers 180 can be mounted for movement with respect to the first winding roll 106 in other manners falling within the spirit and scope of the present invention. For example, the contact fingers 180 can be mounted to a common member (as described above) which itself is mounted for translation with respect to the upper winding roll in any conventional manner. The common member can be guided along tracks, rails, or other guidance devices located adjacent to the first winding roll 106, can be translated by a rack and pinion assembly in a conventional manner, can be mounted upon a subframe movable by pistons, actuators, gears, cables, or other conventional actuation devices, and the like. Actuation of the common member in such a manner can be substantially linear to move the fingers 180 in a substantially radial direction with respect to the first winding roll 106. Linear actuators and actuation assemblies for moving the common member in this manner are well known to those skilled in the art and are not therefore described further herein.

Figure 19:
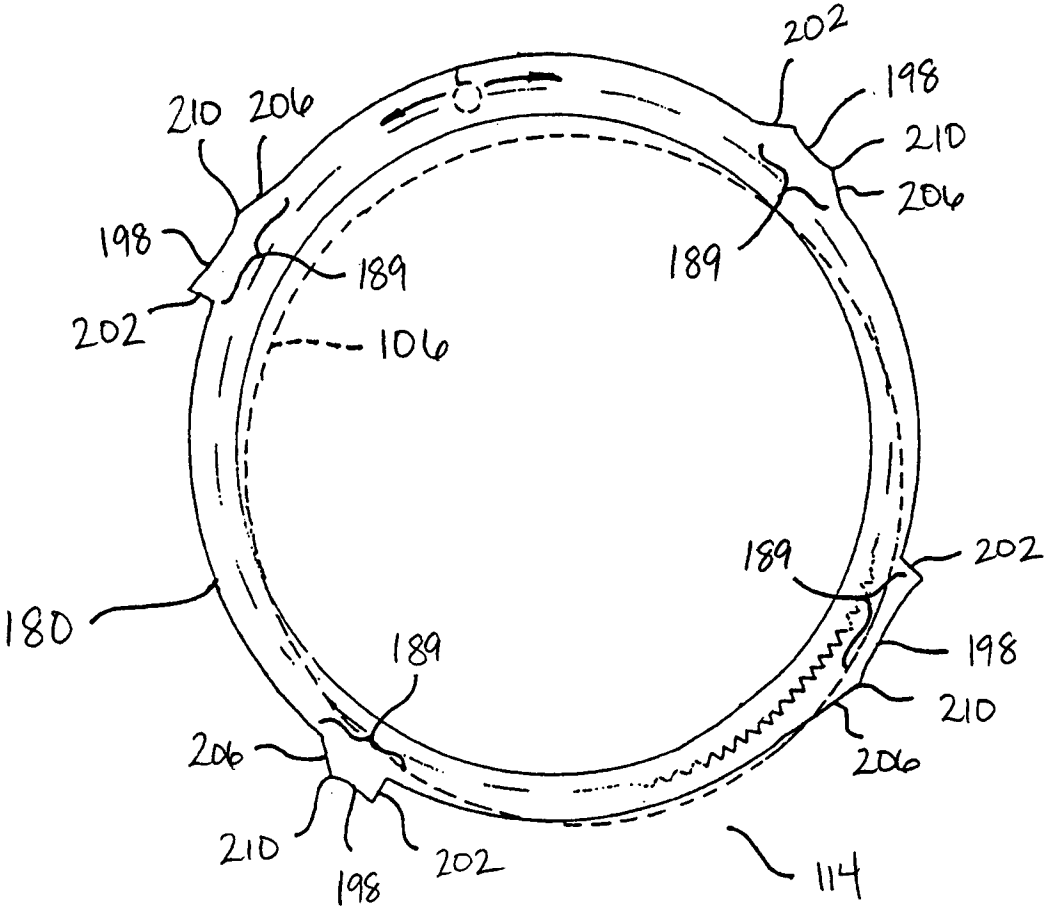
FIG. 19 is a partial view of the rewinder of FIG. 14, illustrating another embodiment of the contact finger.
Figure 2D:
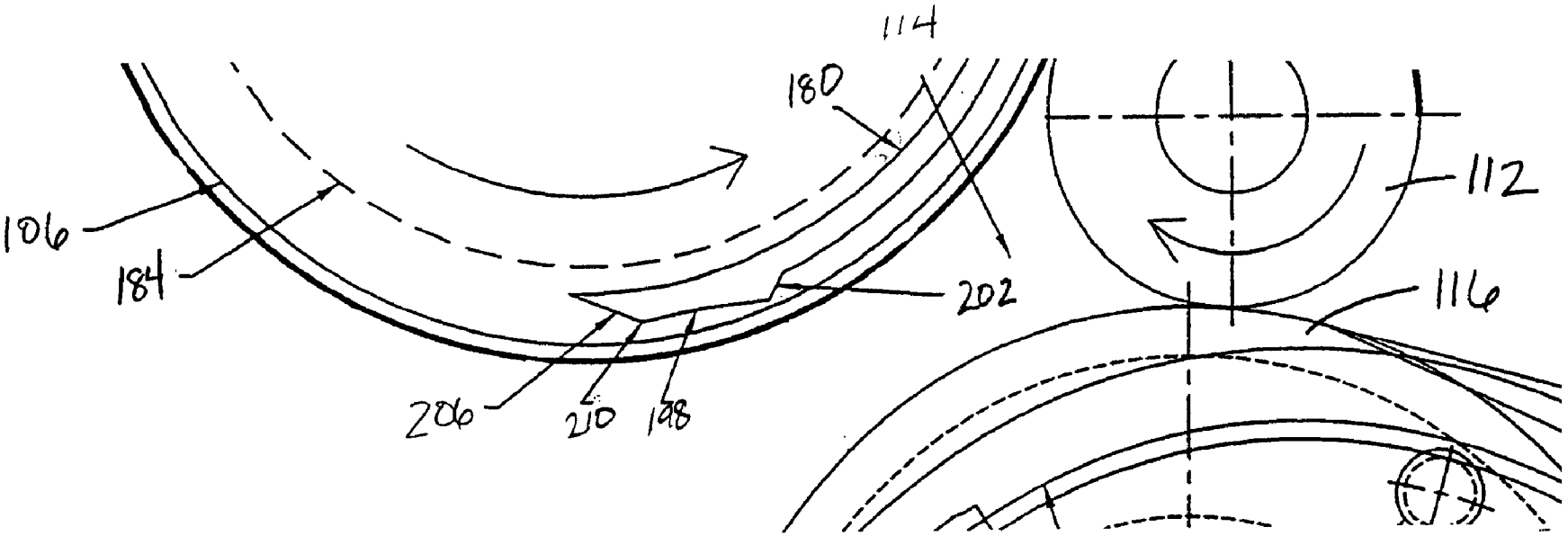

In another embodiment of the present invention, such as illustrated in FIG. 19, the contact fingers 180 are mounted for circumferential movement about the first winding roll 106. In yet another embodiment of the present invention, the contact fingers 180 are mounted for movement in both a radial direction with respect to the first winding roll 106 and a circumferential direction with respect to the first winding roll 106. This arrangement provides the most control over contact finger position and therefore the most control over web separation. Radial and circumferential movement of the contact fingers 180 are preferably performed in substantially the same manners as described above.

In the embodiments where the contact fingers 180 are mounted for movement with respect to the first winding roll 106, the contact fingers 180 are located within the grooves 184 in the first winding roll 106 as the log 112 nears completion and before the web separation bar 164 enters the throat 108 of the rewinder 160. As the web separation bar 164 enters the throat 108, the contact fingers 180 can be actuated to move at least partially out of the grooves 184 to meet the approaching core 122 or web separation bar 164. When actuated, the passing web 102 runs over the contact fingers 180.

Each contact finger 180 can have at least two surface portions 189 and in some embodiments, have three surface portions. As best shown in FIG. 20, each contact finger 180 can have a intermediate surface 198 and a trailing surface 202 substantially facing the throat 108 between the first and second winding rolls 106, 116. Each contact finger 180 also has a lead-in surface 206 adjacent to the intermediate surface 198 and defining an apex 210 therebetween. The purpose of these contact finger elements will now be described in further detail.

By using the contact fingers 180 of the present invention, web separation can be performed in a number of different manners depending upon web material type, rewinder speed, and other operating parameters. In one embodiment of the present invention described above, the web 102 is pressed between the contact fingers 180 and the tip 172 as it is dragged across the contact fingers 180 to separate the web 102. This type of web separation is well adapted to most web material types (e.g., high or low stretch, strong or weak perforation lines, and the like), and is particularly useful for separating web materials capable of significant stretch prior to separation.

In another embodiment of the present invention, the lead-in surface 206 and apex 210 are used to create a more abrupt tension spike in the running web 102 by the core separation tip 172 impacting and moving over the apex 210. The properties of this tension are at least partially dependent upon the shape and steepness of the lead-in surface 206 and the height of the apex 210. A larger tension spike is possible by using a steeper lead-in surface 206 and/or a higher apex 210, while a more gradual increase in web tension is possible by using a longer, shallower lead-in surface 206 and/or a lower apex 210. High tension spikes can be useful for separating relatively strong web material (for example), whereas a lower or more gradual tension increase can be useful for separating high-stretch web materials (for example). By selecting the shape of the apex 210 and lead-in surface 206, the web 102 can be caused to separate when the tip 172 press against the lead-in surfaces 206 or apexes 210 of the contact fingers 180. Alternatively, the apexes 210 and lead-in surfaces 206 can be used to initiate an increase in web tension prior to moving the core 122 over the intermediate surface 198.

In the embodiment of the present invention described above and illustrated in the figures, the contact fingers 180 are coupled to an actuator to be moved into and out of the grooves 184 in the first winding roll 106. In other preferred embodiments, however, it is possible to use contact fingers which do not move in such manner, which are substantially stationary, or which are capable of movement only in a circumferential manner about the first winding roll 106 as described above. The contact fingers 180 in such embodiments are at least partially recessed within the grooves 184 in the first winding roll 106 to permit cores to pass over the contact fingers 180 and then onto the surface of the first winding roll 106. Specifically, each contact finger 180 preferably has at least a portion (i.e., the trailing surface 202) which is recessed within its respective groove 184, while the remainder of the finger 180 is located above the surface of the first winding roll 106. In other embodiments of the present invention, the entire body of each contact finger 180 is recessed within its respective groove 184 even during web separation.

To separate the web 102 in such embodiments, the tips 172 are shaped in such a manner as to shallowly pass into the grooves 184, pushing the web 102 with them to press against the contact fingers 180 and to separate the web 102 in substantially the same manner as described above. The tip 172 in such embodiments preferably takes on a toothed profile to permit the teeth of the tip 172 to fit within the grooves 184 and only contact the contact fingers 180.

The embodiments of the contact fingers 180 as illustrated in FIGS. 15–17 and 19 extend around approximately the entirety of the first winding roll 106. However, it should be noted that the contact fingers 180 can be shorter or longer as desired to extend about less or more of the first winding roll 106. The contact fingers 180 should at least be long enough to provide a surface against which tip 172 can exert pressure to separate the web and to provide sufficient room for a winding log to pass through the throat 108 substantially unimpeded. The contact fingers 180 can pass around a majority of the first winding roll 106 if desired, leaving a sufficient gap to allow radial movement with respect to the first winding roll 106.

With reference to FIGS. 21–24, in another embodiment of the present invention, the travel path P (see FIG. 24) of the web separation bar 164 is adjustable relative to the first axis 214. In this embodiment, the web separation bar 164 is rotatable about a second axis 218 to press the web 102 between the tip 172 of the web separation bar 164 and a surface on the opposite side of the web 102. In the illustrated embodiment, the surface is a surface 189 of the contact fingers 180.

Figure 21:
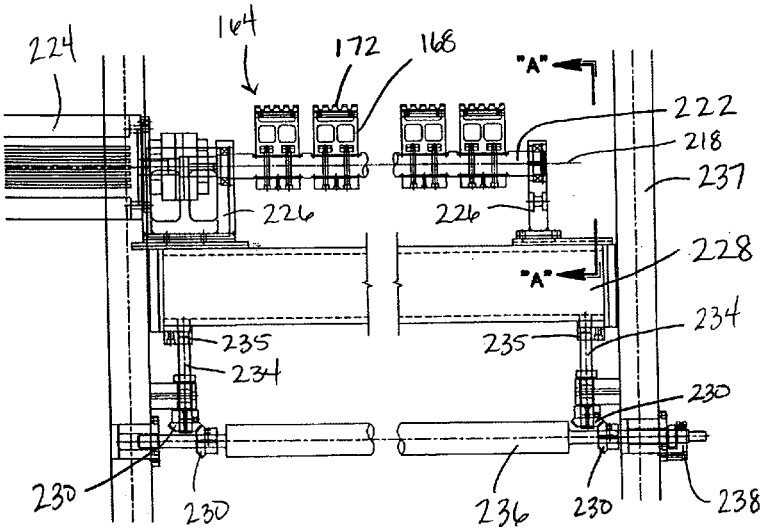
FIG. 21 is a side view of the rewinder of FIG. 14, illustrating how the web separation bar is coupled to the rewinder.
Figure 22:
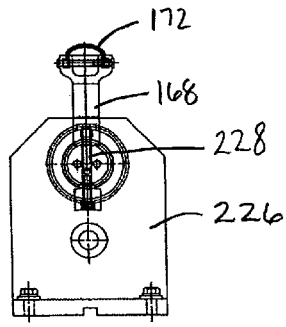
FIG. 22 is a cross-section view taken through line A—A of FIG. 21.

Referring to FIG. 21, the web separation bar 164 is coupled to a shaft 222. The shaft 222 is rotated by a motor 224, which moves the web separation bar 164 into and out of contact with the web 102. The shaft 222 is supported on a bearing support 226. The bearing support 226 is coupled to a movable support 228 that is movable along the frame 237 of the rewinder 160 to adjust the travel path P of the web separation bar 164 with respect to the first winding roll 106. In the illustrated embodiment, the movable support 228 is in sliding contact with the frame 237.

A pair of mating bevel gears 230 are coupled to a support shaft 236, in communication with threaded shafts 234. The gears 230 are operable to move the shafts 234 into and out of collars 235 coupled to the movable support 228. In the illustrated embodiment, the shafts 234 are moved into the movable support 228 via rotation of a manual crank 238 (see FIGS. 23 and 24). However, it is understood that in other embodiments, the shaft 234 can be moved via a motorized control system.

In operation, a user turns the crank 238, which actuates the bevel gears 230. As the gears 230 turn, the threaded shafts 234 turn in the collars 235, moving the movable support 228 toward or away from the first winding roll 106. In the illustrated embodiment, the second axis 218 moves relative to the first axis 214 to move the travel path P of the tip 172. It is further understood that in other embodiments, the first axis 214 can be movable relative to the second axis 218 to adjust the position of the travel path P of the tip 172. In yet other embodiments, the tip 172 itself is movable relative to the second axis.

Figure 23:
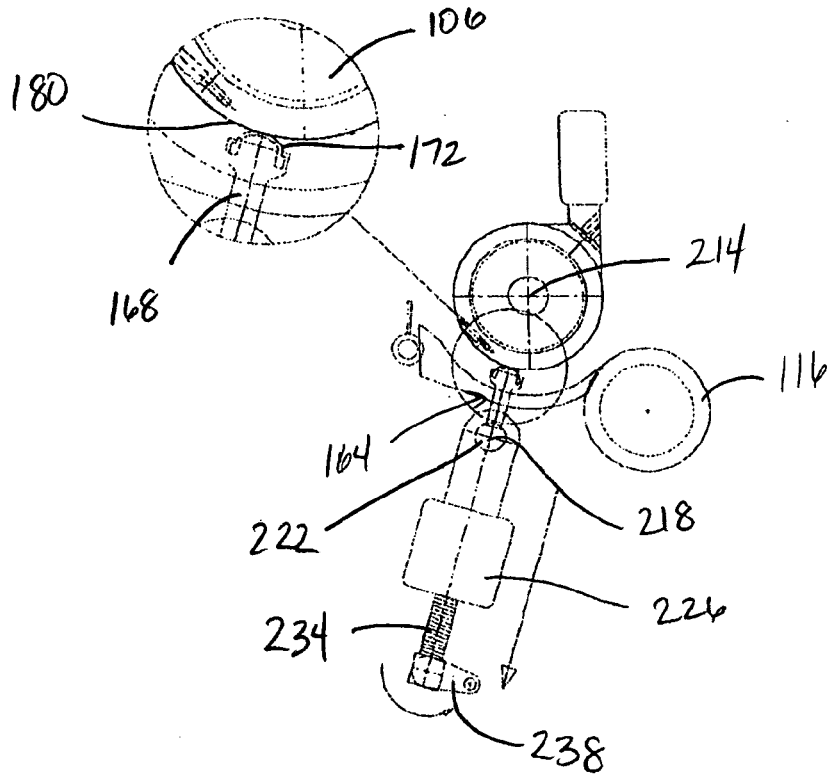
FIG. 23 is a detail view of the rewinder of FIG. 14, illustrating the web separation bar.
Figure 24:
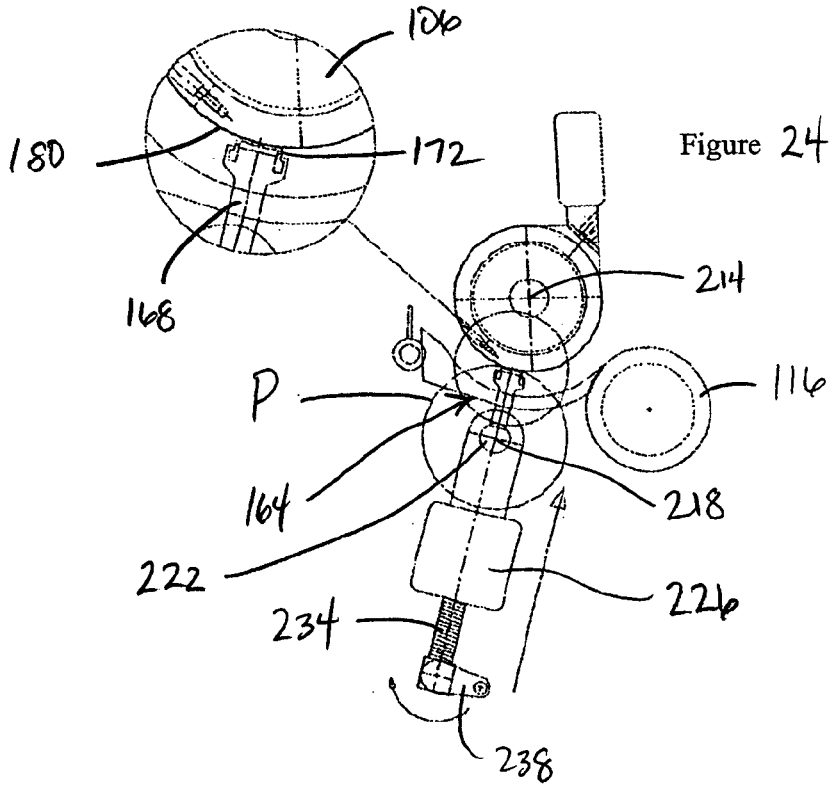
FIG. 24 is a detail view similar to FIG. 23, illustrating the web separation bar moved towards the first winding roll.
Figure 25:
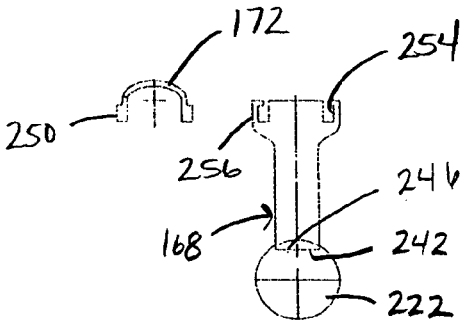
FIG. 25 is a front view of the web separation bar of FIG. 14, with the tip removed from the base.
Figure 26:
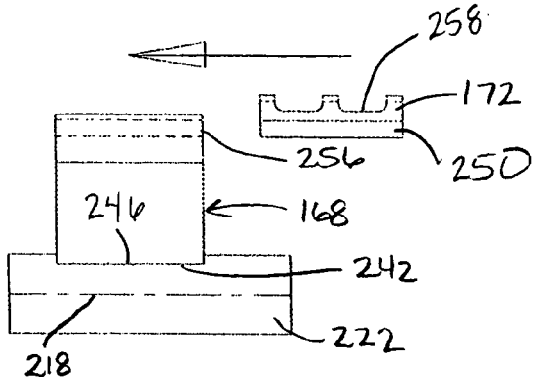
FIG. 26 is a side view of the web separation bar of FIG. 25.
Figure 27:
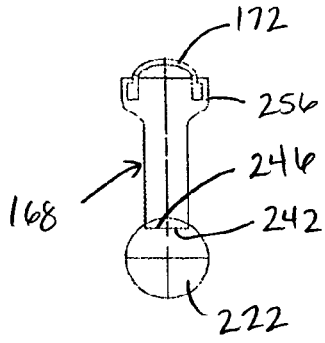
FIG. 27 is a front view of the web separation bar of FIG. 14.
Figure 28:
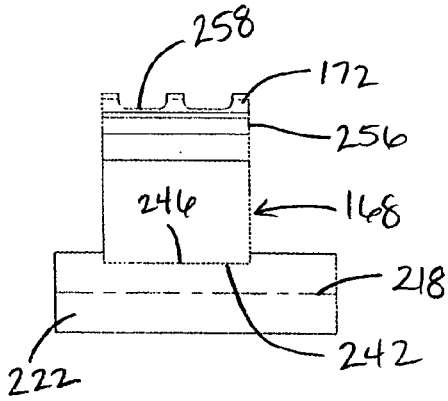
FIG. 28 is a side view of the web separation bar of FIG. 27.

Adjustment of the travel path P of the tip 172 provides adjustment of the interference between the tip 172 and the contact fingers 180. As shown in FIG. 23, rotation of the crank 238 in the counter-clockwise direction moves the web separation bar 164 away from the contact fingers 180, reducing the interference between them. As shown in FIG. 24, rotation of the crank 238 in the clockwise direction moves the web separation bar 164 toward the contact fingers 180, increasing the interference. Adjusting the interference between the bar 164 and the contact fingers 180 can be particularly useful in compensating for worn or malfunctioning portions of the tip 172 or the fingers 180, reducing the necessity for frequent replacement of components of the rewinder 160.

FIGS. 25–28 illustrate the web separation bar 164 in more detail. The base 168 of the web separation bar 164 is composed of a non-resilient material, such as rigid plastic or metal, and is coupled to the shaft 222. In the illustrated embodiment, the base 168 is bolted to the shaft 222, but it is understood that a screw, rod, nail, glue, welding or other suitable mechanical fastening method could also be used to couple the base 168 to the shaft 222. In some embodiments, the base 168 includes a flat surface 242 that interfaces with a flat surface 246 on the shaft 222 to couple the base 168 to the shaft 222. However, it is understood that in other embodiments, the base 168 could include a curved or otherwise shaped surface to mate with the mounting surface of the shaft 222.

The tip 172 is formed of a resilient material, as is discussed in detail above, and includes an interlocking portion 250 that is received within a channel 254 in an upper portion 256 of the base 168 to couple the tip 172 to the base. The interlocking portion 250 is shaped to slide into the channel 254 and be held in place within the channel 254 during use of the web separation bar 164, but yet be easy to remove and replace should the tip 172 begin to wear over the course of repeated uses in separating the web 102. The configuration of the interlocking portion 250 and the channel 254 are such that no other fastening mechanism is required to hold the tip 172 in place during use of the web separation bar 164. It is understood that in other embodiments, the interlocking portion 250 and channel 254 can have any mating configuration or shape such that the tip 172 is received by and held within the base 168. The tip 172 includes at least one recess 258 therein for receiving a portion of the first winding roll 106 during web separation such that the tip 172 presses the web only against the contact finger 180 and not against the high friction surface of the winding roll 106.

Figure 29:
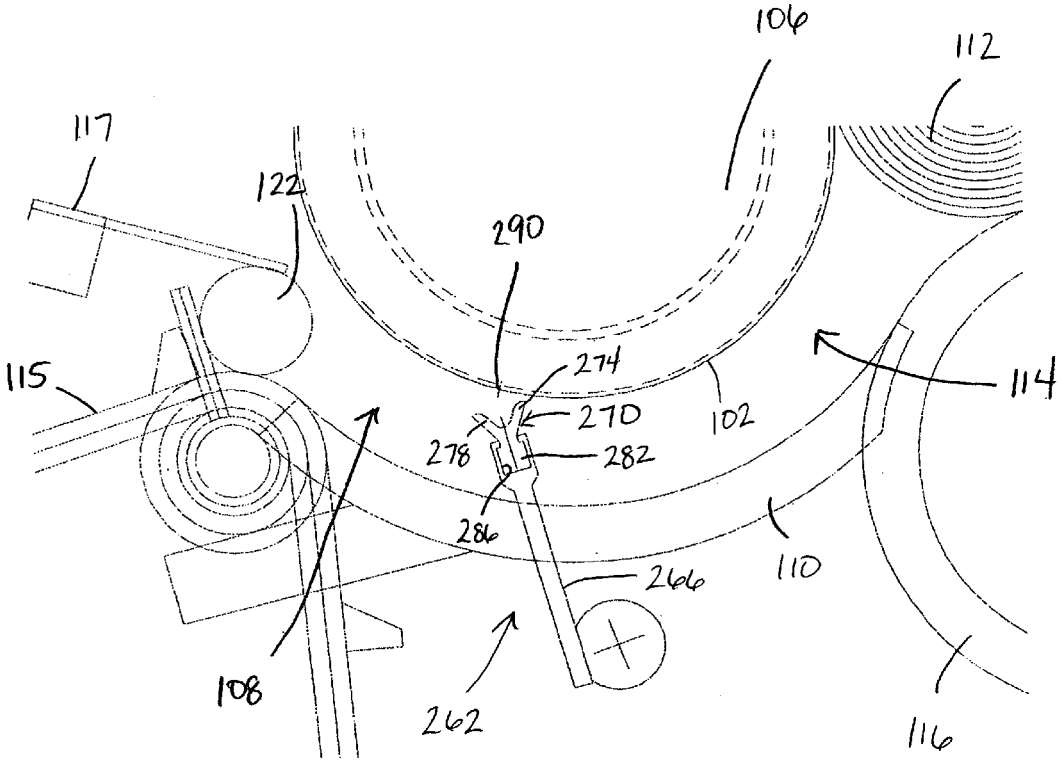
FIG. 29 is a detail view of the rewinder of FIG. 14 according to an additional embodiment of the web separation bar for the present invention.
Figure 30:
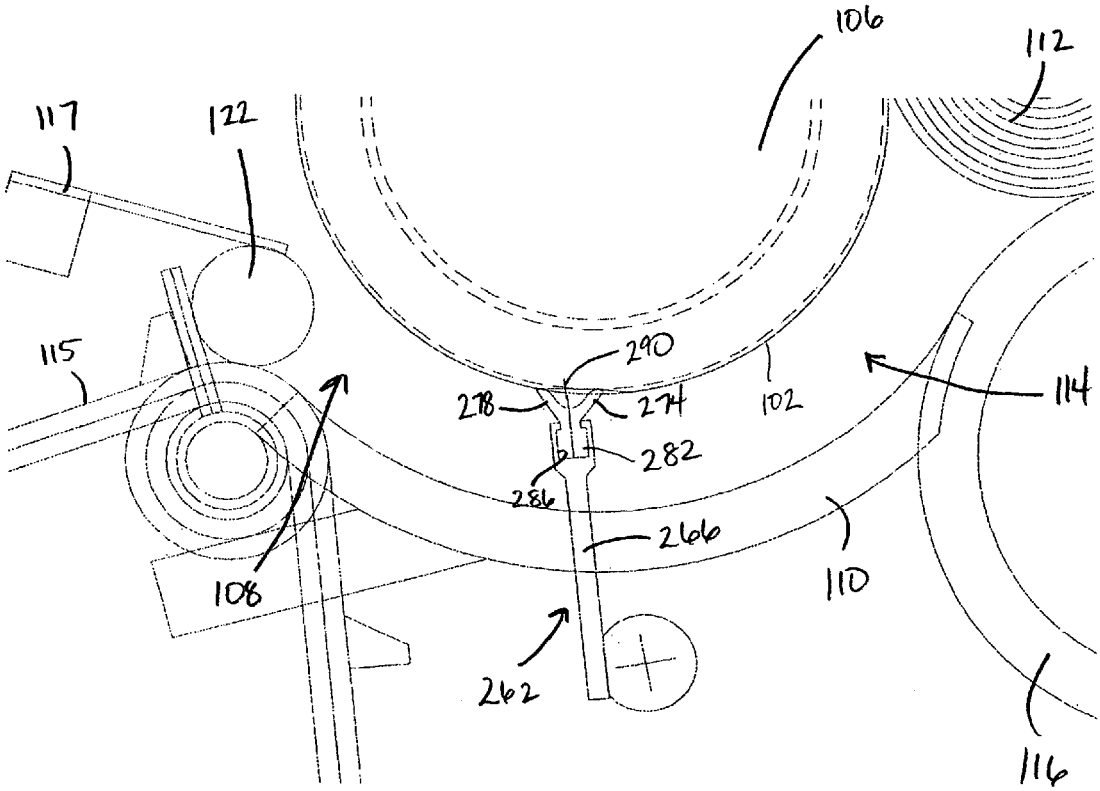
FIGS. 30 and 31 are detail views of the rewinder of FIG. 29, showing the operation of the web separation bar as the web is separated.
Figure 31:
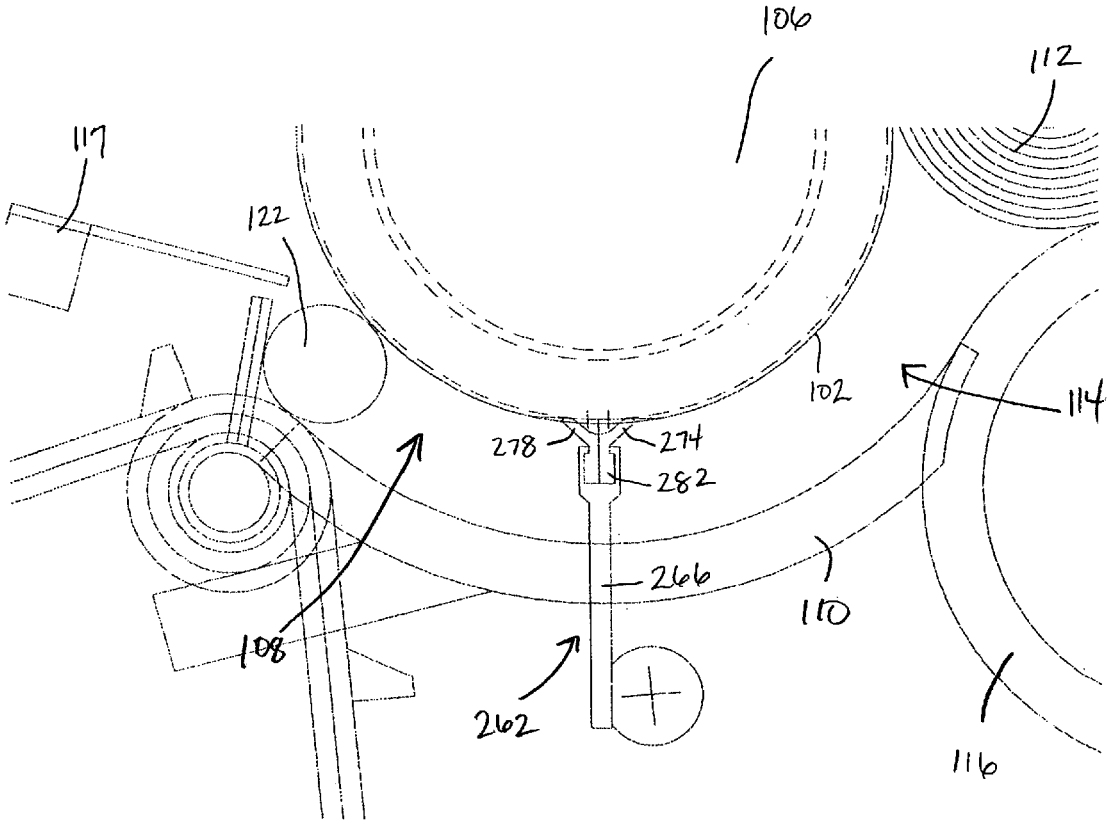

FIGS. 29–31 illustrate another web separation bar 262 according to one embodiment of the present invention. The web separation bar 262 is movable in a similar manner to the web separation bar 164 discussed above and is movable into contact with the web 102 to separate the web 102. The web separation bar 262 includes a base 266 coupled to the rewinder 160 for movement toward the web 102, and a tip 270 coupled to the base 266. The tip 270 comprises a resilient material, such as polyurethane, and includes a first portion 274 and a second portion 278. It is understood that the tip can comprise various other materials, including but not limited to rubber, silicone, ultra-high molecular weight polyethylene, aluminum, steel, or any other material capable of contacting and separating the web 102 without departing from the present invention. Similar to the web separation bar 164 described above, the tip 270 includes an interlocking portion 282 that is received by a channel 286 in the base 266 to couple the tip 270 to the base 266. The illustrated tip 270 is substantially Y-shaped, but other shapes can also be used.

Many web separators slow the leading edge of the web as the web is separated at a perforation. This can result in tension disturbances in the web and poor transfer of the leading edge of the separated web through the web separation process, especially where the distance between perforations is less than or equal to 3.5 inches. As the tip 270 of the web separation bar 262 is rotated into contact with the web 102, the motion of the web separation bar 262 is timed such that a perforation 290 in the web exists between the first and second portions 274, 278 of the tip 270. In one embodiment, the perforation 290 is substantially centered between the first and second portions 274, 278. The tip 270 stretches the web 102 between the first and second portions 274, 278 until the web 102 separates along the perforation 290, as the motion of the web and the friction between the web 102 and the tip 270 move the first and second portions 274, 278 apart from each other. As the first and second portions 274, 278 spread apart to stretch the web 102, the tip 270 continues to drive the leading edge of the web forward throughout the web separation process, resulting in a better web transfer to a new core. In the illustrated embodiment, the tip 270 of the web separation bar is moving at a tip velocity approximately equal to the velocity of the moving web as the tip 270 contacts the web 102.

In some rewinder designs, a lack of web tension, especially in the cross machine direction, can also cause inconsistent web separation. The first and second portions 274, 278 of the tip 270 in the present design can first force the web 102 against the upper roll 106 (or contact finger 180) and then spread the web 102, generating the required tension to rupture the web along the perforation 290. In some embodiments, the web separation bar 262 includes a plurality of tips 270 mounted along the bar 262 for separating the web along the cross machine direction.

Various features of the invention are set forth in the following claims.

We claim:

1. An apparatus capable of winding a web onto a core, the apparatus comprising:

a first winding roll;

a second winding roll located a distance from the first winding roll to define a winding nip therebetween;

a core support plate on which the core is received and moved toward the winding nip;

a contact finger located adjacent the first winding roll; and a web separation bar movable toward the web to press the web against the contact finger to separate the web.

2. The apparatus of claim 1, wherein the contact finger is recessed within the first winding roll.

3. The apparatus of claim 1, wherein a first portion of the contact finger is recessed within the first winding roll and a second portion of the contact finger is movable to a position outside an outer surface of the first winding roll, the web separation bar movable into and out of pressing relationship against the second portion of the contact finger.

4. The apparatus of claim 3, wherein the second portion is a concave surface providing substantially constant pressure against the web separation element during mutual contact between the concave surface and the web separation element.

5. The apparatus of claim 1, wherein the contact finger is elongated in shape and is curved about at least a portion of the first winding roll.

6. The apparatus of claim 1, wherein the contact finger is ring-shaped and is located about the first winding roll.

7. The apparatus of claim 6, wherein the first winding roll includes a high friction surface, and wherein the contact finger includes a low friction surface.

8. The apparatus of claim 6, wherein the contact finger includes a first piece and a second piece, and wherein the first piece is removably coupled to the second piece.

9. The apparatus of claim 6, wherein the first winding roll has a center, and wherein the contact finger is concentric with the center of the first winding roll.

10. The apparatus of claim 9, wherein the contact finger has a diameter, and wherein the diameter of the contact finger is equal to the diameter of the first winding roll.

11. The apparatus of claim 1, wherein the contact finger has an uneven surface with an apex, the apex providing maximum pressure between the contact finger and the web separation bar during mutual contact between the uneven surface and the web separation bar.

12. The apparatus of claim 1, wherein the contact finger has a lead-in surface and a trailing surface, the lead-in and trailing surfaces substantially facing the passing web.

13. The apparatus of claim 1, wherein the web separation bar is movable in a non-transverse direction to the web.

14. The apparatus of claim 1, wherein the web separation bar comprises a plurality of tips which are movable into contact with the web.

15. The apparatus of claim 1, wherein the winding nip is further defined by a rider roll.

16. The apparatus of claim 1, wherein the web separation bar is rotatable into and out of pressing relationship with the web.

17. The apparatus of claim 1, wherein the web separation bar includes a tip, and wherein the tip includes at least one recess.

18. The apparatus of claim 17, wherein the tip includes a plurality of recesses, and wherein the recesses are configured to receive a portion of the first winding roll therein as the tip moves into contact with the web.

19. The apparatus of claim 17, wherein the tip is configured to press the web only against the contact finger.

20. A method of winding a web onto a core in a rewinder, the rewinder winding a web of material adjacent at least one of a first winding roll and a second winding roll, the first and second winding rolls defining a nip in the rewinder, the method comprising:

passing the web over a surface of the first winding roll;

passing the web across a contact finger located adjacent to the first winding roll;

moving a core onto at least one core support plate and toward the nip;

moving a web separation bar toward the web, pressing the web between the web separation bar and the contact finger;

separating the web into a leading edge and a trailing edge;

moving the web separation bar away from the web; and winding the leading edge around the core.

21. The method of claim 20, wherein pressing the web includes moving the web toward the contact finger.

22. The method of claim 20, wherein pressing the web includes drawing the web separation bar across a surface of the contact finger.

23. The method of claim 22, wherein pressing the web further includes drawing the web across an apex of the contact finger surface to generate a tension spike in the running web.

24. The method of claim 20, further comprising perforating the web.

25. The method of claim 24, further comprising contacting the web on both sides of a perforation and stretching the web until the perforation ruptures.

26. The method of claim 20, wherein the at least one core support plate includes a plurality of spaced core support plates, and wherein moving the web separation bar towards the web includes moving a portion of the web separation bar between and through the spaced core support plates.

27. The method of claim 20, further comprising recessing at least a portion of the contact finger within the winding roll, and wherein pressing the web includes pressing the web only between the web separation bar and the contact finger.

28. An apparatus capable of winding a web onto a core, the apparatus comprising:

a first winding roll rotatable about a first axis;

a second winding roll located a distance from the first winding roll to define a winding nip therebetween; and a web separation bar having a tip, the web separation bar rotatable about a second axis to press the web between the tip and a surface on the opposite side of the web to separate the web, the tip defining a travel path during rotation of the web separation bar;

wherein the position of the travel path relative to the first axis is adjustable.

29. The apparatus of claim 28, wherein the second axis is movable relative to the first axis.

30. The apparatus of claim 29, wherein the second axis is moved via rotation of a manual crank.

31. The apparatus of claim 29, wherein the second axis is moved via a motorized control system.

32. The apparatus of claim 28, wherein the first axis is movable relative to the second axis.

33. The apparatus of claim 28, wherein the tip is movable relative to the second axis.

34. The apparatus of claim 28, wherein the web separation bar is coupled to a movable support, the web separation bar supported by bearings on the movable support.

35. The apparatus of claim 34, further comprising mating bevel gears that move a shaft into and out of a bearing support, the bearing support coupled to the movable support.

36. The apparatus of claim 35, wherein the shaft is threaded, and wherein the bearing support includes mating threads, and wherein adjusting the travel path relative to the first axis includes threading the shaft into and out of the bearing support.

37. The apparatus of claim 28, wherein the travel path of the tip is circular.

38. A method of winding a web onto a core in a rewinder, the rewinder winding a web of material adjacent at least one of a first winding roll and a second winding roll, the first and second winding rolls defining a nip in the rewinder, the first winding roll rotatable about a first axis, the method comprising:

passing the web over a surface of the first winding roll;

moving a core onto at least one core support plate and toward the nip;

rotating a web separation bar about a second axis to press the web between a tip of the web separation bar and a surface on the opposite side of the web;

defining a travel path with the tip during rotation of the web separation bar;

separating the web into a leading edge and a trailing edge;

moving the web separation bar away from the web;

winding the leading edge around the core; and adjusting the position of the travel path relative to the first axis.

39. The method of claim 38, wherein adjusting the position of the travel path relative to the first axis includes moving the second axis relative to the first axis.

40. The method of claim 39, wherein moving the second axis relative to the first axis includes rotating a manual crank.

41. The method of claim 39, wherein moving the second axis relative to the first axis includes actuating a motorized control system.

42. The method of claim 38, wherein adjusting the position of the travel path relative to the first axis includes moving the first axis relative to the second axis.

43. The method of claim 38, wherein adjusting the position of the travel path relative to the first axis includes moving the tip relative to the second axis.

44. An apparatus capable of winding a web onto a core, the apparatus comprising:

a first winding roll;

a second winding roll located a distance from the first winding roll to define a winding nip therebetween; and a web separation bar including a base and a tip, wherein the base slidably receives the tip coupling the tip to the base, and wherein the web separation bar is movable toward the web to press the web between the tip and a surface on the opposite side of the web.

45. The apparatus of claim 44, wherein the web separation bar is rotatable into and out of pressing relationship with the web.

46. The apparatus of claim 44, wherein the web separation bar comprises a plurality of tips which are movable into contact with the web.

47. The apparatus of claim 44, wherein the base of the web separation bar includes a channel and the tip includes a mating interlocking portion, the channel receiving the interlocking portion to couple the tip to the base.

48. The apparatus of claim 44, wherein the tip is composed of a resilient material.

49. The apparatus of claim 44, wherein the tip includes at least one recess.

50. The apparatus of claim 49, wherein the tip includes a plurality of recesses, and wherein the recesses are configured to receive a portion of the first winding roll therein as the tip moves into contact with the web.

51. The apparatus of claim 44, wherein the base comprises a non-resilient material.

52. The apparatus of claim 51, wherein the non-resilient material is rigid plastic.

53. The apparatus of claim 51, wherein the non-resilient material is metal.

54. The apparatus of claim 44, wherein the base is coupled to a shaft.

55. The apparatus of claim 54, wherein the base is bolted to the shaft.

56. The apparatus of claim 54, wherein the base includes a flat surface, and wherein the flat surface of the base interfaces with a flat surface on the shaft to couple the base to the shaft.

57. A method of assembling a web separation bar for use in a rewinder, the rewinder winding a web of material adjacent at least one of a first winding roll and a second winding roll, the first and second winding rolls defining a nip in the rewinder, the rewinder further including a web separation bar movable to press the web between a tip of the web separation bar and a surface on the opposite side of the web to separate the web into a leading edge and a trailing edge, the method comprising:

providing a base and a tip; and sliding the tip into the base, the engagement between the tip and the base coupling the tip to the base.

58. The method of claim 57, further comprising forming at least one channel within an upper portion of the base.

59. The method of claim 58, wherein the tip includes an interlocking portion configured to cooperate with the channel within the base, and wherein sliding the tip into the base includes sliding the interlocking portion of the tip into the channel in the base.

60. An apparatus capable of winding a perforated web onto a core, the web moving through the apparatus at a web velocity, the apparatus comprising:

a first winding roll;

a second winding roll located a distance from the first winding roll to define a winding nip therebetween;

a core support plate on which the core is received and moved toward the winding nip; and a web separation bar movable toward the web to separate the web;

wherein the web separation bar comprises a base and a tip, and wherein the tip contacts the web on both sides of a perforation and breaks the web along the perforation.

61. The apparatus of claim 60, wherein the tip includes a first portion and a second portion such that the tip stretches the web between the first and second portions until the web separates along the perforation.

62. The apparatus of claim 61, wherein the tip is composed of a resilient material such that stretching the web between the first and second portions spreads the first and second portions apart with respect to each other.

63. The apparatus of claim 61, wherein the tip is substantially Y-shaped.

64. The apparatus of claim 60, wherein the perforation is substantially centered between the first and second portions of the tip when the tip contacts the web.

65. The apparatus of claim 60, wherein the web separation bar is rotatable into and out of pressing relationship with the web.

66. The apparatus of claim 60, wherein the web separation bar is accelerated to a velocity substantially equal to the velocity of the web.

67. A method of winding a perforated web onto a core in a rewinder, the rewinder winding a web of material adjacent at least one of a first winding roll and a second winding roll, the first and second winding rolls defining a nip in the rewinder, the method comprising:

passing the web over a surface of the first winding roll;

moving a core onto at least one core support plate and toward the nip;

moving a web separation bar toward the web, pressing the web between the web separation bar and a surface on the opposite side of the web;

contacting the web on both sides of a perforation with the separation bar, separating the web into a leading edge and a trailing edge;

moving the web separation bar away from the web; and winding the leading edge around the core.

68. The method of claim 67, wherein the web separation bar comprises a base and a tip, and wherein contacting the web on both sides of a perforation includes contacting the web with the tip.

69. The method of claim 68, wherein contacting the web with the tip includes stretching the web between first and second portions of the tip.

70. The method of claim 69, wherein the tip is composed of a resilient material, and wherein stretching the web between the first and second portions of the tip includes spreading the first and second portions apart with respect to each other.

71. The method of claim 67, wherein moving the web separation bar toward the web includes rotating the web separation bar into and out of pressing relationship with the web.

72. The method of claim 67, further comprising accelerating the web separation bar to a velocity substantially equal to the velocity of the web.

73. The method of claim 67, wherein the web separation bar includes a plurality of tips, and wherein moving the separation bar toward the web presses the web between the plurality of tips and the first winding roll.

* * * * *